US010054412B2

(12) United States Patent
Rastegar et al.

(10) Patent No.: US 10,054,412 B2
(45) **Date of Patent: *Aug. 21, 2018**

(54) ROTARY-TYPE MECHANISMS FOR INERTIAL IGNITERS FOR THERMAL BATTERIES AND G-SWITCHES FOR MUNITIONS AND THE LIKE

(71) Applicants: Jahangir S Rastegar, Stony Brook, NY (US); Jacques Fischer, Sound Beach, NY (US); Qing Tu, Stony Brook, NY (US)

(72) Inventors: Jahangir S Rastegar, Stony Brook, NY (US); Jacques Fischer, Sound Beach, NY (US); Qing Tu, Stony Brook, NY (US)

(73) Assignee: OMNITEK PARTNERS LLC, Ronkonkoma, NY (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/333,092

(22) Filed: Oct. 24, 2016

(65) Prior Publication Data

US 2017/0038187 A1 Feb. 9, 2017

Related U.S. Application Data

(62) Division of application No. 13/659,872, filed on Oct. 24, 2012, now Pat. No. 9,476,684.

(60) Provisional application No. 61/551,405, filed on Oct. 25, 2011.

(51) Int. Cl.
*F42C 15/24* (2006.01)
*F42C 15/40* (2006.01)

(52) U.S. Cl.
CPC ..... *F42C 15/24* (2013.01); *F42C 15/40* (2013.01)

(58) Field of Classification Search
CPC .... F42C 1/04; F42C 1/06; F42C 15/24; F42C 15/26
USPC ..... 102/252, 254, 256, 272, 274
See application file for complete search history.

(56) References Cited

U.S. PATENT DOCUMENTS

| | | | | | |
|---|---|---|---|---|---|
| H124 | H * | 9/1986 | Antonuzzi | F42C 15/24 | 102/247 |
| 5,024,157 | A * | 6/1991 | Nishikawa | B60R 21/33 | 102/252 |
| 5,483,846 | A * | 1/1996 | Sakamoto | B60R 21/33 | 102/252 |
| 5,670,764 | A * | 9/1997 | Sakamoto | B60R 21/017 | 200/61.45 R |
| 6,240,848 | B1 * | 6/2001 | Specht | B60R 22/4652 | 102/216 |
| 7,587,979 | B2 * | 9/2009 | Rastegar | F42C 9/02 | 102/222 |

(Continued)

*Primary Examiner* — Bret Hayes

(57) ABSTRACT

A mechanism including: a toggle link rotatably connected to a base structure; a first element associated with the toggle link; a second element associated with the base structure; a biasing element having a first end attached to the base structure and a second end attached to the toggle link such that the first element moves towards the second element; and a blocking element movably disposed between a first position blocking movement of the toggle link and a second position allowing to first element of the toggle link to move towards the second element when the base structure undergoes an acceleration event greater than a predetermined threshold.

7 Claims, 24 Drawing Sheets

(56) References Cited

U.S. PATENT DOCUMENTS

| | | | | |
|---|---|---|---|---|
| 8,191,476 | B2 * | 6/2012 | Rastegar | F42C 9/02 102/220 |
| 8,434,408 | B2 * | 5/2013 | Rastegar | F42C 9/02 102/221 |

* cited by examiner

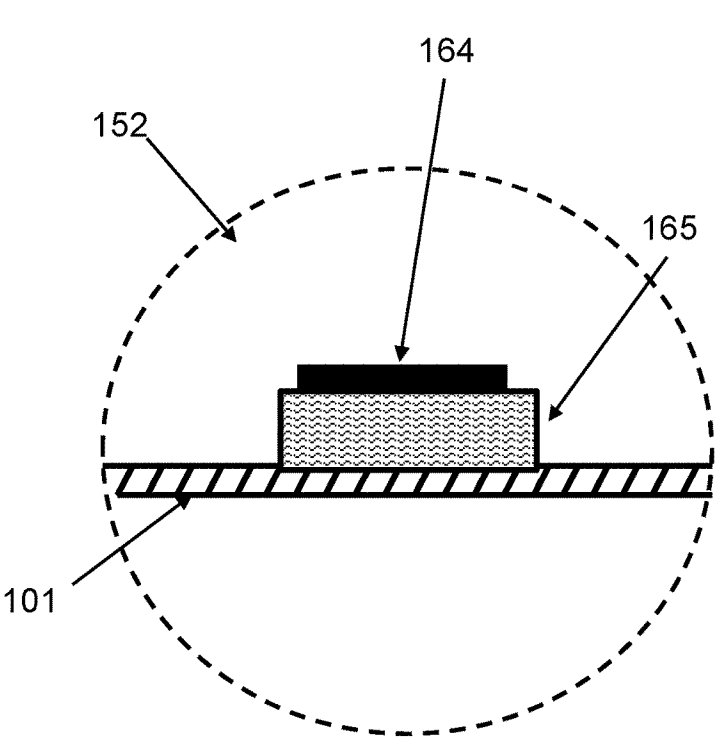
Close-Up View "B"
Figure 7b2
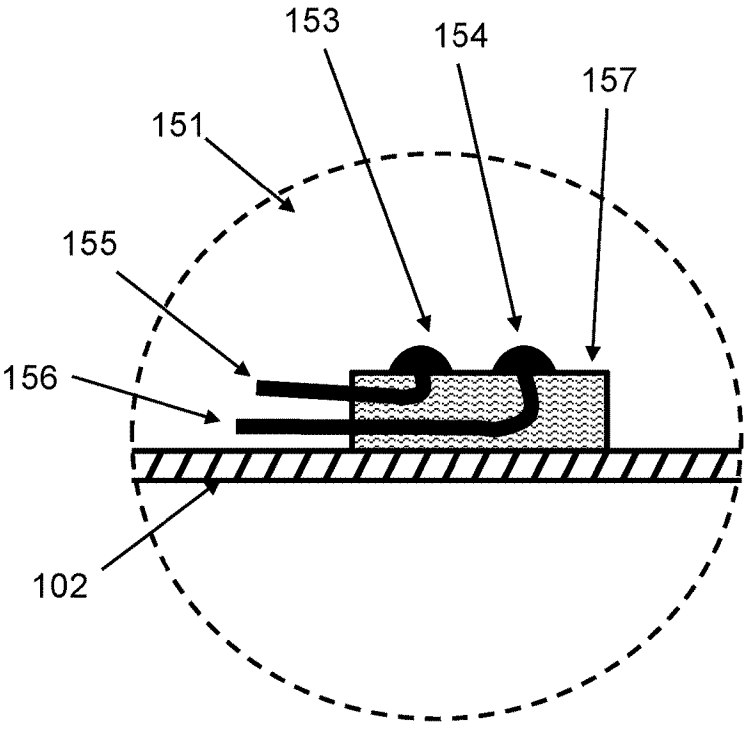
Close-Up View "A"
Figure 7b1

Close-Up View "D"

Close-Up View "C"

ROTARY-TYPE MECHANISMS FOR INERTIAL IGNITERS FOR THERMAL BATTERIES AND G-SWITCHES FOR MUNITIONS AND THE LIKE

CROSS-REFERENCE TO RELATED APPLICATION

This application is a divisional application of U.S. application Ser. No. 13/659,872, filed on Oct. 24, 2012, issued as U.S. Pat. No. 9,476,684 on Oct. 25, 2016, which claims benefit to U.S. Provisional Application 61/551,405 filed on Oct. 25, 2011, the entire contents of each of which is incorporated herein by reference.

BACKGROUND

1. Field

The present invention relates generally to linear or rotary acceleration (deceleration) or rotary speed (spin) operated mechanical delay mechanisms, and more particularly for inertial igniters for thermal batteries used in gun-fired munitions and other similar applications or electrical G-switches to open (close) a normally closed (open) circuit upon the device experiencing a prescribed said acceleration or rotary speed profile threshold.

2. Prior Art

Thermal batteries represent a class of reserve batteries that operate at high temperatures. Unlike liquid reserve batteries, in thermal batteries the electrolyte is already in the cells and therefore does not require a distribution mechanism such as spinning. The electrolyte is dry, solid and non-conductive, thereby leaving the battery in a non-operational and inert condition. These batteries incorporate pyrotechnic heat sources to melt the electrolyte just prior to use in order to make them electrically conductive and thereby making the battery active. The most common internal pyrotechnic is a blend of Fe and $KClO_4$. Thermal batteries utilize a molten salt to serve as the electrolyte upon activation. The electrolytes are usually mixtures of alkali-halide salts and are used with the Li(Si)/$FeS_2$ or Li(Si)/$CoS_2$ couples. Some batteries also employ anodes of Li(Al) in place of the Li(Si) anodes. Insulation and internal heat sinks are used to maintain the electrolyte in its molten and conductive condition during the time of use. Reserve batteries are inactive and inert when manufactured and become active and begin to produce power only when they are activated.

Thermal batteries have long been used in munitions and other similar applications to provide a relatively large amount of power during a relatively short period of time, mainly during the munitions flight. Thermal batteries have high power density and can provide a large amount of power as long as the electrolyte of the thermal battery stays liquid, thereby conductive. The process of manufacturing thermal batteries is highly labor intensive and requires relatively expensive facilities. Fabrication usually involves costly batch processes, including pressing electrodes and electrolytes into rigid wafers, and assembling batteries by hand. The batteries are encased in a hermetically-sealed metal container that is usually cylindrical in shape. Thermal batteries, however, have the advantage of very long shelf life of up to 20 years that is required for munitions applications.

Thermal batteries generally use some type of igniter to provide a controlled pyrotechnic reaction to produce output gas, flame or hot particles to ignite the heating elements of the thermal battery. There are currently two distinct classes of igniters that are available for use in thermal batteries. The first class of igniter operates based on electrical energy. Such electrical igniters, however, require electrical energy, thereby requiring an onboard battery or other power sources with related shelf life and/or complexity and volume requirements to operate and initiate the thermal battery. The second class of igniters, commonly called "inertial igniters", operates based on the firing acceleration. The inertial igniters do not require onboard batteries for their operation and are thereby often used in high-G munitions applications such as in gun-fired munitions and mortars.

In general, the inertial igniters, particularly those that are designed to operate at relatively low impact levels, have to be provided with the means for distinguishing events such as accidental drops or explosions in their vicinity from the firing acceleration levels above which they are designed to be activated. This means that safety in terms of prevention of accidental ignition is one of the main concerns in inertial igniters.

In general, electrical igniters use some type of sensors and electronics decision making circuitry to perform the aforementioned event detection tasks. Electrical igniters, however, required external electrical power sources for their operation. And considering the fact that thermal batteries (reserve batteries) are generally used in munitions to avoid the use of active batteries with their operational and shelf life limitations, and the aforementioned need for additional sensory and decision making electronics, electrical igniters are not the preferred means of activating thermal batteries and the like, particularly in gun-fired munitions, mortars and the like.

Currently available technology (U.S. Pat. Nos. 7,437,995; 7,587,979; and 7,587,980; U.S. Application Publication No. 2009/0013891 and U.S. application Ser. No. 61/239,048; 12/079,164; 12/234,698; 12/623,442; 12/774,324; and Ser. No. 12/794,763 the entire contents of each of which are incorporated herein by reference) has provided solution to the requirement of differentiating accidental drops during assembly, transportation and the like (generally for drops from up to 7 feet over concrete floors that can result in impact deceleration levels of up to 2000 G over up to 0.5 milli-seconds). The available technology differentiates the above accidental and initiation (all-fire) events by both the resulting impact induced inertial igniter (essentially the inertial igniter structure) deceleration and its duration with the firing (setback) acceleration level that is experienced by the inertial igniter and its duration, thereby allowing initiation of the inertial igniter only when the initiation (all-fire) setback acceleration level as well as its designed duration (which in gun-fired munitions of interest such as artillery rounds or mortars or the like is significantly longer than drop impact duration) are reached. This mode of differentiating the "combined" effects of accidental drop induced deceleration and all-fire initiation acceleration levels as well as their time durations (both of which would similarly tend to affect the start of the process of initiation by releasing a striker mass that upon impact with certain pyrotechnic material(s) or the like would start the ignition process) is possible since the aforementioned up to 2000 G impact deceleration level is applied over only 0.5 milli-seconds (msec), while the (even lower level) firing (setback) acceleration (generally not much lower than 900 G) is applied over significantly longer durations (generally over at least 8-10 msec).

The safety mechanisms disclosed in the above referenced patents and patent applications can be thought of as a mechanical delay mechanism, after which a separate initiation system is actuated or released to provide ignition of the device pyrotechnics. Such inertia-based igniters therefore comprise of two components so that together they provide the aforementioned mechanical safety (delay mechanism) and to provide the required striking action to achieve ignition of the pyrotechnic elements. The function of the safety system is to hold the striker in position until a specified acceleration time profile actuates the safety system and releases the striker, allowing it to accelerate toward its target under the influence of the remaining portion of the specified acceleration time profile. The ignition itself may take place as a result of striker impact, or simply contact or "rubbing action" or proximity. For example, the striker may be akin to a firing pin and the target akin to a standard percussion cap primer. Alternately, the striker-target pair may bring together one or more chemical compounds whose combination with or without impact will set off a reaction resulting in the desired ignition.

In addition, inertial igniters that are used in munitions that are loaded into ships by cranes for transportation are highly desirable to satisfy another no-fire requirement arising from accidental dropping of the munitions from heights reached during ship loading. This requirement generally demands no-fire (no initiation) due to drops from up to 40 feet that can result in impact induced deceleration levels (of the inertial igniter structure) of up to 18,000 Gs acting over up to 1 msec time intervals. Currently, inertial igniters that can satisfy this no-fire requirement when the all-fire (setback) acceleration levels are relatively low (for example, as low as around 900 G and up to around 3000 Gs or above) are not available. In addition, the currently known methods of constructing inertial igniters for satisfying 7 feet drop safety (resulting in up to 2,000 Gs of impact induced deceleration levels for up to 0.5 msec impulse) requirement cannot be used to achieve safety (no-initiation) for very high impact induced decelerations resulting from high-height drops of up to 40 feet (up to 18,000 Gs of impact induced decelerations lasting up to 1 msec). This is the case for several reasons. Firstly, impacts following drops occur at significantly higher impact speeds for drops from higher heights. For example, considering free drops and for the sake of simplicity assuming that no drag to be acting on the object, impact velocities for a drop from a height of 40 feet is approximately 15.4 m/sec as compared to a drop from a height of 7 feet is approximately 6.4 m/sec, or about 2.3 times higher for 40 feet drops). Secondly, the 7 feet drops over concrete floor lasts only up to 0.5 seconds, whereas 40 feet drop induced inertial igniter deceleration levels of up to 18,000 Gs can have durations of up to 1 msec. As a result, the distance traveled by the inertial igniter striker mass releasing element is so much higher for the aforementioned 40 feet drops as compared to 7 feet drops that it has made the development of inertial igniters that are safe (no-initiation occurring) as a result of such 40 feet drops impractical.

A schematic of a cross-section of a conventional thermal battery and inertial igniter assembly is shown in FIG. 1. In thermal battery applications, the inertial igniter 10 (as assembled in a housing) is generally positioned above the thermal battery housing 11 as shown in FIG. 1. Upon ignition, the igniter initiates the thermal battery pyrotechnics positioned inside the thermal battery through a provided access 12. The total volume that the thermal battery assembly 16 occupies within munitions is determined by the diameter 17 of the thermal battery housing 11 (assuming it is cylindrical) and the total height 15 of the thermal battery assembly 16. The height 14 of the thermal battery for a given battery diameter 17 is generally determined by the amount of energy that it has to produce over the required period of time. For a given thermal battery height 14, the height 13 of the inertial igniter 10 would therefore determine the total height 15 of the thermal battery assembly 16. To reduce the total volume that the thermal battery assembly 16 occupies within a munitions housing, it is therefore important to reduce the height of the inertial igniter 10. This is particularly important for small thermal batteries since in such cases the inertial igniter height with currently available inertial igniters can be almost the same order of magnitude as the thermal battery height.

A design of an inertial igniter for satisfying the safety (no initiation) requirement when dropped from heights of up to 7 feet (up to 2,000 G impact deceleration with a duration of up to 0.5 msec) is described below using one such embodiment disclosed in co-pending patent application Ser. No. 12/835,709, the contents of which are incorporated herein by reference. An isometric cross-sectional view of this embodiment 200 of the inertia igniter is shown in FIG. 2. The full isometric view of the inertial igniter 200 is shown in FIG. 3. The inertial igniter 200 is constructed with igniter body 201, consisting of a base 202 and at least three posts 203. The base 202 and the at least three posts 203, can be integral but may be constructed as separate pieces and joined together, for example by welding or press fitting or other methods commonly used in the art. The base of the housing 202 is also provided with at least one opening 204 (with a corresponding opening in the thermal battery—not shown) to allow the ignited sparks and fire to exit the inertial igniter into the thermal battery positioned under the inertial igniter 200 upon initiation of the inertial igniter pyrotechnics 204, FIG. 2, or percussion cap primer when used in place of the pyrotechnics as disclosed therein.

A striker mass 205 is shown in its locked position in FIG. 2. The striker mass 205 is provided with vertical surfaces 206 that are used to engage the corresponding (inner) surfaces of the posts 203 and serve as guides to allow the striker mass 205 to ride down along the length of the posts 203 without rotation with an essentially pure up and down translational motion. The vertical surfaces 206 may be recessed to engage the inner three surfaces of the properly shaped posts 203.

In its illustrated position in FIGS. 2 and 3, the striker mass 205 is locked in its axial position to the posts 203 by at least one setback locking ball 207. The setback locking ball 207 locks the striker mass 205 to the posts 203 of the inertial igniter body 201 through the holes 208 provided in the posts 203 and a concave portion such as a dimple (or groove) 209 on the striker mass 205 as shown in FIG. 2. A setback spring 210, which is preferably in compression, is also provided around but close to the posts 203 as shown in FIGS. 2 and 3. In the configuration shown in FIG. 2, the locking balls 207 are prevented from moving away from their aforementioned locking position by the collar 211. The collar 211 can be provided with partial guide 212 ("pocket"), which are open on the top as indicated by numeral 213. The guides 213 may be provided only at the locations of the locking balls 207 as shown in FIGS. 2 and 3, or may be provided as an internal surface over the entire inner surface of the collar 211 (not shown). The advantage of providing local guides 212 is that it would result in a significantly larger surface contact between the collar 211 and the outer surfaces of the posts 203, thereby allowing for smoother movement of the collar 211 up and down along the length of the posts 203. In addition, they would prevent the collar 211 from rotating relative to the inertial igniter body 201 and makes the collar stronger and more massive. The advantage of providing a continuous inner recess guiding surface for the locking balls 207 is that it would require fewer machining processes during the collar manufacture.

The collar 211 can ride up and down the posts 203 as can be seen in FIGS. 2 and 3, but is biased to stay in its upper most position as shown in FIGS. 2 and 3 by the setback spring 210. The guides 212 are provided with bottom ends 214, so that when the inertial igniter is assembled as shown in FIGS. 2 and 3, the setback spring 210 which is biased (preloaded) to push the collar 211 upward away from the igniter base 201, would hold the collar 211 in its uppermost position against the locking balls 207. As a result, the assembled inertial igniter 200 stays in its assembled state and would not require a top cap to prevent the collar 211 from being pushed up and allowing the locking balls 207 from moving out and releasing the striker mass 205.

In this embodiment, a one part pyrotechnics compound 215 (such as lead styphnate or some other similar compounds) is used as shown in FIG. 2. The surfaces to which the pyrotechnic compound 215 is attached can be roughened and/or provided with surface cuts, recesses, or the like and/or treated chemically as commonly done in the art (not shown) to ensure secure attachment of the pyrotechnics material to the applied surfaces. The use of one part pyrotechnics compound makes the manufacturing and assembly process much simpler and thereby leads to lower inertial igniter cost. The striker mass is preferably provided with a relatively sharp tip 216 and the igniter base surface 202 is provided with a protruding tip 217 which is covered with the pyrotechnics compound 215, such that as the striker mass is released during an all-fire event and is accelerated down, impact occurs mostly between the surfaces of the tips 216 and 217, thereby pinching the pyrotechnics compound 215, thereby providing the means to obtain a reliable initiation of the pyrotechnics compound 215.

Alternatively, a two-part pyrotechnics compound, e.g., potassium chlorate and red phosphorous, may be used. When using such a two-part pyrotechnics compound, the first part, in this case the potassium chlorate, can be provided on the interior side of the base in a provided recess, and the second part of the pyrotechnics compound, in this case the red phosphorous, is provided on the lower surface of the striker mass surface facing the first part of the pyrotechnics compound. In general, various combinations of pyrotechnic materials may be used for this purpose with an appropriate binder to firmly adhere the materials to the inertial igniter (e.g., metal) surfaces.

Alternatively, instead of using the pyrotechnics compound 215, FIG. 2, a percussion cap primer can be used. An appropriately shaped striker tip can be provided at the tip 216 of the striker mass 205 (not shown) to facilitate initiation upon impact.

The basic operation of the embodiment 200 of the inertial igniter of FIGS. 2 and 3 is now described. In case of any non-trivial acceleration in the axial direction 218 which can cause the collar 211 to overcome the resisting force of the setback spring 210 will initiate and sustain some downward motion of the collar 211. The force due to the acceleration on the striker mass 205 is supported at the dimples 209 by the locking balls 207 which are constrained inside the holes 208 in the posts 203. If the acceleration is applied over long enough time in the axial direction 218, the collar 211 will translate down along the axis of the assembly until the setback locking balls 205 are no longer constrained to engage the striker mass 205 to the posts 203. If the event acceleration and its time duration is not sufficient to provide this motion (i.e., if the acceleration level and its duration are less than the predetermined threshold), the collar 211 will return to its start (top) position under the force of the setback spring 210 once the event has ceased.

Assuming that the acceleration time profile was at or above the specified "all-fire" profile, the collar 211 will have translated down past the locking balls 207, allowing the striker mass 205 to accelerate down towards the base 202. In such a situation, since the locking balls 207 are no longer constrained by the collar 211, the downward force that the striker mass 205 has been exerting on the locking balls 207 will force the locking balls 207 to move outward in the radial direction. Once the locking balls 207 are out of the way of the dimples 209, the downward motion of the striker mass 205 is no longer impeded. As a result, the striker mass 205 accelerates downward, causing the tip 216 of the striker mass 205 to strike the pyrotechnic compound 215 on the surface of the protrusion 217 with the requisite energy to initiate ignition.

In the embodiment 200 of the inertial igniter shown in FIGS. 2 and 3, the setback spring 210 is of a helical wave spring type fabricated with rectangular cross-sectional wires (such as the ones manufactured by Smalley Steel Ring Company of Lake Zurich, Ill.). This is in contrast with the helical springs with circular wire cross-sections used in other available inertial igniters. The use of the aforementioned rectangular cross-section wave springs or the like has the following significant advantages over helical springs that are constructed with wires with circular cross-sections. Firstly and most importantly, as the spring is compressed and nears its "solid" length, the flat surfaces of the rectangular cross-section wires come in contact, thereby generating minimal lateral forces that would otherwise tend to force one coil to move laterally relative to the other coils as is usually the case when the wires are circular in cross-section. Lateral movement of the coils can, in general, interfere with the proper operation of the inertial igniter since it could, for example, jam a coil to the outer housing of the inertial igniter (not shown in FIGS. 2 and 3), which is usually desired to house the igniter 200 or the like with minimal clearance to minimize the total volume of the inertial igniter. In addition, the laterally moving coils could also jam against the posts 203 thereby further interfering with the proper operation of the inertial igniter. The use of the wave springs with rectangular cross-section would therefore significantly increase the reliability of the inertial igniter and also significantly increase the repeatability of the initiation for a specified all-fire condition. The second advantage of the use of the aforementioned wave springs with rectangular cross-section, particularly since the wires can and are usually made thin in thickness and relatively wide, is that the solid length of the resulting wave spring can be made to be significantly less than an equivalent regular helical spring with circular cross-section. As a result, the total height of the resulting inertial igniter can be reduced. Thirdly, since the coil waves are in contact with each other at certain points along their lengths and as the spring is compressed, the length of each wave is slightly increased, therefore during the spring compression the friction forces at these contact points do certain amount of work and thereby absorb certain amount of energy. The presence of this friction force ensures that the firing acceleration and very rapid compression of the spring would to a lesser amount tend to "bounce" the collar 211 back up and thereby increasing the possibility that it would interfere with the exit of the locking balls from the dimples 209 of the striker mass 205 and the release of the striker mass 205. The above characteristic of the wave springs with rectangular cross-section should therefore also significantly enhance the performance and reliability of the inertial igniter 200 while at the same time allowing its height (and total volume) to be reduced.

The striker mass 205 and striker tip 216 may be a monolithic design with the striking tip 216 being machined as shown in FIG. 2 or as a boss protruding from the striker mass, or the striker tip 216 may be a separate piece, possibly fabricated from a material that is significantly harder than the striker mass material, and pressed or otherwise permanently fixed to the striker mass. A two-piece design would be favorable to the need for a striker whose density is different than steel, but whose tip would remain hard and tough by attaching a steel ball, hemisphere, or other shape to the striker mass. A monolithic design, however, would be generally favorable to manufacturing because of the reduction of part quantity and assembly operations.

In the embodiment 200 of FIGS. 2 and 3, following ignition of the pyrotechnics compound 215, the generated flames and sparks are designed to exit downward through the opening 204 to initiate the thermal battery below. Alternatively, if the thermal battery is positioned above the inertial igniter 200, the opening 204 can be eliminated and the striker mass could be provided with at least one opening (not shown) to guide the ignition flame and sparks up through the striker mass 205 to allow the pyrotechnic materials (or the like) of a thermal battery (or the like) positioned above the inertial igniter 200 (not shown) to be initiated.

Alternatively, side ports may be provided to allow the flame to exit from the side of the igniter to initiate the pyrotechnic materials (or the like) of a thermal battery or the like that is positioned around the body of the inertial igniter. Other alternatives known in the art may also be used.

In FIGS. 2 and 3, the inertial igniter embodiment 200 is shown without any outside housing. In many applications, as shown in the schematics of FIG. 4*a* (4*b*), the inertial igniter 240 (250) is placed securely inside the thermal battery 241 (251), either on the top (FIG. 4*a*) or bottom (FIG. 4*b*) of the thermal battery housing 242 (252). This is particularly the case for relatively small thermal batteries. In such thermal battery configurations, since the inertial igniter 240 (250) is inside the hermetically sealed thermal battery 241 (251), there is no need for a separate housing to be provided for the inertial igniter itself. In this assembly configuration, the thermal battery housing 242 (252) is provided with a separate compartment 243 (253) for the inertial igniter. The inertial igniter compartment 243 (253) is preferably formed by a member 244 (254) which is fixed to the inner surface of the thermal battery housing 242 (253), preferably by welding, brazing or very strong adhesives or the like. The separating member 244 (254) is provided with an opening 245 (255) to allow the generated flame and sparks following the initiation of the inertial igniter 240 (250) to enter the thermal battery compartment 246 (256) to activate the thermal battery 241 (251). The separating member 244 (254) and its attachment to the internal surface of the thermal battery housing 242 (252) must be strong enough to withstand the forces generated by the firing acceleration.

For larger thermal batteries, a separate compartment (similar to the compartment 10 over or possibly under the thermal battery hosing 11 as shown in FIG. 1) can be provided above, inside or under the thermal battery housing for the inertial igniter. An appropriate opening (similar to the opening 12 in FIG. 1) can also be provided to allow the flame and sparks generated as a result of inertial igniter initiation to enter the thermal battery compartment (similar to the compartment 14 in FIG. 1) and activate the thermal battery.

The inertial igniter 200, FIGS. 2 and 3 may also be provided with a housing 260 as shown in FIG. 5. The housing 260 can be one piece and fixed to the base 202 of the inertial igniter structure 201, such as by soldering, laser welding or appropriate epoxy adhesive or any other of the commonly used techniques to achieve a sealed compartment. The housing 260 may also be crimped to the base 202 at its open end 261, in which case the base 202 can be provided with an appropriate recess 262 to receive the crimped portion 261 of the housing 260. The housing can be sealed at or near the crimped region via one of the commonly used techniques such as those described above.

It is appreciated by those skilled in the art that by varying the mass of the striker 205, the mass of the collar 211, the spring rate of the setback spring 210, the distance that the collar 211 has to travel downward to release the locking balls 207 and thereby release the striker mass 205, and the distance between the tip 216 of the striker mass 205 and the pyrotechnic compound 215 (and the tip of the protrusion 217), the designer of the disclosed inertial igniter 200 can try to match the all-fire and no-fire impulse level requirements for various applications as well as the safety (delay or dwell action) protection against accidental dropping of the inertial igniter and/or the munitions or the like within which it is assembled.

Briefly, the safety system parameters, i.e., the mass of the collar 211, the spring rate of the setback spring 210 and the dwell stroke (the distance that the collar 210 has to travel downward to release the locking balls 207 and thereby release the striker mass 205) must be tuned to provide the required actuation performance characteristics. Similarly, to provide the requisite impact energy, the mass of the striker 205 and the aforementioned separation distance between the tip 216 of the striker mass and the pyrotechnic compound 215 (and the tip of the protrusion 217) must work together to provide the specified impact energy to initiate the pyrotechnic compound when subjected to the remaining portion of the prescribed initiation acceleration profile after the safety system has been actuated.

In certain applications, however, the inertial igniter is required to withstand no-fire accelerations that are significantly higher in amplitude and that are relatively long in duration For example, when the firing (setback) acceleration may be in the range of 900-3000 Gs with a duration of over 8-12 msec, while for safety considerations, the inertial igniter may be required to withstand (no-fire) accelerations resulting from drops from heights as high as 40 feet (which can generate inertial igniter impact deceleration levels of up to 18,000 Gs with durations of up to 1 msec). This is readily shown to be the case since for drops from high-heights of the order of 40 feet that result in impact induced inertial igniter deceleration levels of up to 18,000 Gs with durations of up to 1 msec, due to the high velocity of the inertial igniter and its various elements (including the collar 211, FIG. 2) at the time of impact and the long duration of the impact induced inertial igniter deceleration, the amount of downward travel of the collar 211 (FIG. 2) relative to the inertial igniter body (element 203) will become so long that makes such inertial igniters impractical for munitions applications. This is particularly the case for inertial igniters used in munitions with relatively low all-fire (setback) acceleration levels, since the compressive preload in the striker spring 210 (FIG. 2) needs to be low (since the dynamic force resulting by the firing acceleration acting on the inertia of the collar 211 must be significantly less than the compressive preloading level of the striker spring 210 to allow the release of the striker mass 205 when all-fire acceleration level is reached and thereby cause igniter initiation), thereby the fast downward translation of the collar 211 relative to the inertial igniter body 203 is minimally impeded by the upward force generated by the striker spring 210.

Thus, it is shown that it is not possible to use the methods used in the design of currently inertial igniters of the type shown in FIG. 2 (e.g., see U.S. Pat. Nos. 7,587,979; 7,587,980 and 7,832,335; U.S. Patent application Publication Nos. 2009/0013891 and 2010/0307362 and U.S. patent application Ser. Nos. 13/207,355; 12/079,164; 12/794,763; 12/835,709 and 13/207,280, each of which is incorporated herein by reference) except the ones provided in U.S. patent application Ser. No. 13/180,469 filed on Jul. 11, 2011 (incorporated herein by reference) to provide no-fire safety for accidental drops from height of up to 7 feet to design inertial igniters that provide no-fire safety for the aforementioned drops from heights of up to 40 feet.

The aforementioned currently available inertial igniters have a number of shortcomings for use in thermal batteries for munitions, particularly for munitions that are launched at relatively low setback accelerations, such as a few hundred or even less G levels. This is particularly the case for inertial igniters that are required to withstand high G accelerations with significant durations caused by accidental drops from the aforementioned high heights of up to around 40 feet.

In addition, in certain munitions or similar applications, the munitions are subjected to relatively low setback accelerations with relatively short duration. Currently available inertial igniters designs cannot provide both safety and initiation requirements since in such applications the setback acceleration duration is not long enough to allow the safety mechanism actuate or release the striker mass as well as accelerate the striker mass to a high enough velocity to initiate the pyrotechnic material.

In addition, in recent years, new and improved chemistries and manufacturing processes have been developed that promise the development of lower cost and higher performance thermal batteries that could be produced in various shapes and sizes, including their small and miniaturized versions. Thus, it is important that the developed inertial igniters be relatively small and suitable for small and low power thermal batteries, particularly those that are being developed for use in miniaturized fuzing, future smart munitions, and other similar applications.

SUMMARY

The need to differentiate accidental and initiation accelerations by the resulting impulse level of the event necessitates the employment of a safety system which is capable of allowing initiation of the igniter only during high total impulse levels. The safety mechanisms described herein are novel mechanical rotary and rotary-toggle type mechanism, which respond to linear and/or rotary (spin generating) acceleration applied to the inertial igniter. If the applied acceleration reaches or passes the designed initiation levels and if its duration is long enough, i.e., larger than any expected to be experienced as the result of accidental drops or explosions in their vicinity or other non-firing events, i.e., if the resulting impulse levels are lower than those indicating gun-firing, then the delay mechanism returns to its original pre-acceleration configuration, and a separate initiation system is not actuated or released to provide ignition of the pyrotechnics. Otherwise, the separate initiation system is actuated or released to provide ignition of the pyrotechnics.

Inertia-based igniters must therefore comprise two components so that together they provide the aforementioned mechanical safety (mechanical delay mechanism) and to provide the required striking action to achieve ignition of the pyrotechnic elements. The function of the safety system is to prevent the striker mechanism to initiate the pyrotechnic, i.e., to delay full actuation or release of the striker mechanism until a specified acceleration time profile has been experienced. The safety system should then fully actuate or release the striker, allowing it to accelerate toward its target under the influence of the remaining portion of the specified acceleration time profile and/or certain spring provided force. The ignition itself may take place as a result of striker impact, or simply contact or proximity or a rubbing action. For example, the striker may be akin to a firing pin and the target akin to a standard percussion cap primer. Alternately, the striker-target pair may bring together one or more chemical compounds whose combination with or without impact or a rubbing will set off a reaction resulting in the desired ignition.

Herein is described novel rotary and rotary-toggle type mechanism mechanical mechanisms that provide the means to achieve aforementioned required munitions safety due to accidental dropping or the like while providing the means to activate the inertial igniter when subjected to setback acceleration in a very small size and volume packages (as compared to prior art mechanisms). These mechanisms are particularly suitable for inertial igniters, but may also be used in other similar applications, for example as so-called electrical G-switches that open (or close) an electrical circuit only when the device is subjected to a prescribed acceleration profile (impulse) threshold. Also disclosed are a number of inertial igniter embodiments that combine such mechanical delay mechanisms (safety systems) with impact or rubbing or contact based initiation systems.

A need therefore exists for the development of novel methods and resulting mechanical inertial igniters for thermal batteries used in gun fired munitions, mortars, small rockets and for other similar applications that occupy very small volumes and eliminate the need for external power sources and can initiate at relatively low setback impulse levels (i.e., either relatively low acceleration levels or relatively short setback acceleration duration or both relatively low acceleration levels and relatively short setback acceleration duration). The development of such novel miniature inertial ignition mechanism concepts also requires the identification or design of appropriate pyrotechnics and their initiation mechanisms.

A need also therefore exists for the development of novel methods and resulting mechanical inertial igniters for thermal batteries used in gun fired munitions, mortars and for other similar applications that occupy very small volumes and eliminate the need for external power sources and can initiate when subjected to high spin rates, such as those in the order of 100 or more cycles per second, or relatively high rotary (spin) accelerate rates. Such inertial igniters must in general be safe and in particular they should not initiate if dropped, e.g., from up to 7 feet onto a concrete floor (generally corresponding to acceleration levels of up to 2,000 G for a duration of up to 0.5 msec) for certain applications, and from up to 40 feet (generally corresponding to acceleration levels of up to 18,000 G for a duration of up to 1 msec). The development of such novel miniature inertial ignition mechanism concepts also requires the identification or design of appropriate pyrotechnics and their initiation mechanisms.

The innovative inertial igniters would preferably be scalable to thermal batteries of various sizes, in particular to miniaturized igniters for small size thermal batteries. Reliability is also of much concern since the rounds should have a shelf life of up to 20 years and could generally be stored at temperatures of sometimes in the range of −65 to 165 degrees F. This requirement is usually satisfied best if the igniter pyrotechnic is in a sealed compartment. The inertial igniters must also consider the manufacturing costs and simplicity in design to make them cost effective for munitions applications.

A need also therefore exists for the development of novel methods and resulting mechanical G-switches for use in gun fired munitions, mortars, small rockets or other similar applications that can be used to open (close) a normally closed (open) electrical circuitry or the like upon the device using such G-switch experiencing an acceleration profile corresponding to one of the aforementioned setback acceleration profiles (i.e., either relatively low acceleration levels or relatively short setback acceleration duration or both relatively low acceleration levels and relatively short setback acceleration duration). Such G-switches must occupy relatively small volumes and do not require external power sources for their operation. In many gun fired munitions and mortar and other similar applications, such G-switches must not operate when dropped, e.g., from up to 7 feet onto a concrete floor (generally corresponding to acceleration levels of up to 2,000 G for a duration of up to 0.5 msec) for certain applications, and from up to 40 feet (generally corresponding to acceleration levels of up to 18,000 G for a duration of up to 1 msec).

A need also exists for the development of novel methods and resulting mechanical G-switches for use in gun fired munitions, mortars, small rockets or other similar applications that can be used to open (close) a normally closed (open) electrical circuitry or the like upon the device using such G-switch experiencing high spin rates, such as those in the order of 100 or more cycles per second, or relatively high rotary (spin) accelerate rates. Such G-switches must occupy relatively small volumes and do not require external power sources for their operation. In many gun fired munitions and mortar and other similar applications, such G-switches must not operate when dropped, e.g., from up to 7 feet onto a concrete floor (generally corresponding to acceleration levels of up to 2,000 G for a duration of up to 0.5 msec) for certain applications, and from up to 40 feet (generally corresponding to acceleration levels of up to 18,000 G for a duration of up to 1 msec).

BRIEF DESCRIPTION OF THE DRAWINGS

These and other features, aspects, and advantages of the apparatus of the present invention will become better understood with regard to the following description, appended claims, and accompanying drawings where:

FIGS. 7*b*1, 7*b*2 and 7*c* illustrate the schematic of details of general configuration of the contact elements of a normally open version of the electrical G-switch of FIG. 7*a*.

DETAILED DESCRIPTION

Figure 6A:
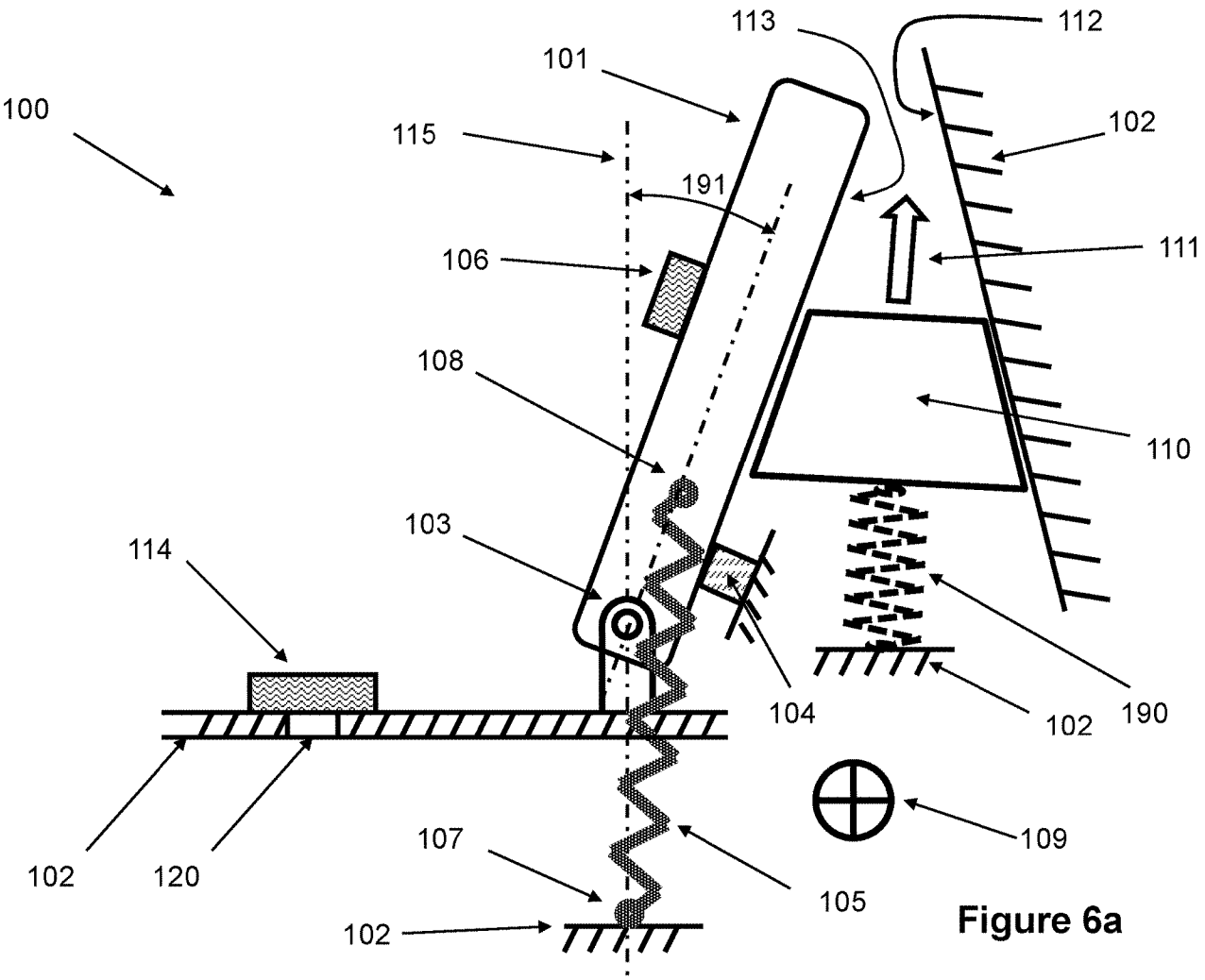
FIG. 6*a* illustrates a schematic of the first embodiment of an inertia igniter configured to initiate pyrotechnic materials when subjected all-fire spin rate.

One embodiment 100 of the present inertial igniter invention is shown in the schematic of FIG. 6*a*. In this embodiment, the striker component of the inertial igniter 100 is a toggle type of mechanism with the toggle link 101, which is attached to the structure of the inertial igniter 102, by a pin joint indicated with numeral 103. In its rest and normal position shown in FIG. 6*a*, the striker (toggle) link 101 is biased to rest on its right-most position shown in FIG. 6*a*, against the stop 104, by the spring 105. The spring 105 is preloaded in tension, and serves as the toggle mechanism spring, and is attached to the structure 102 on the end 107 and to the striker link 101 on the other end 108, preferably with pin or pin-like joints. The elements 106 and 114, fixed to the striker link 101 and the inertial igniter structure 102, respectively, are the two components of the ignition pyrotechnic. Alternatively, a one piece pyrotechnic element may be used, in which case the element 106 is preferably the ignition impact mass or pin and the element 114 is preferably the one piece impact initiated pyrotechnic element.

The inertial igniter 100 is intended to be used in spinning munitions and is designed to activate by centrifugal forces generated by the spinning of the round about its long axis as described below. In the schematic of FIG. 6*a*, the inertial igniter 100 is being viewed along the long axis of the spinning round with the axis of spinning rotation (center of rotation of the inertial igniter as viewed in the schematic of FIG. 6*a*) is considered to be at the point 109.

Figure 6B:
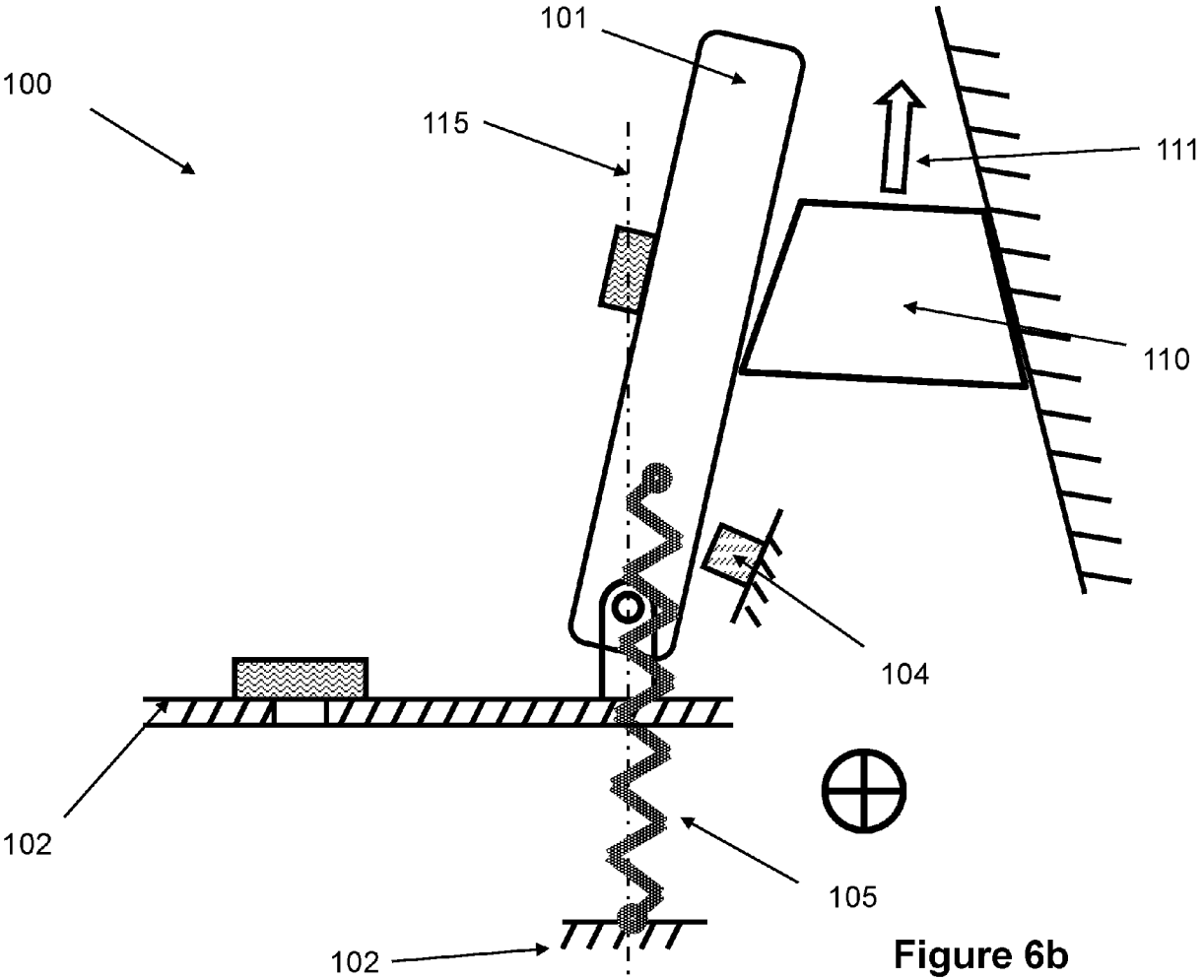
FIGS. 6*b*-6*e* illustrate the inertia igniter of FIG. 6*a* in various stages of spin rates.
Figure 6C:
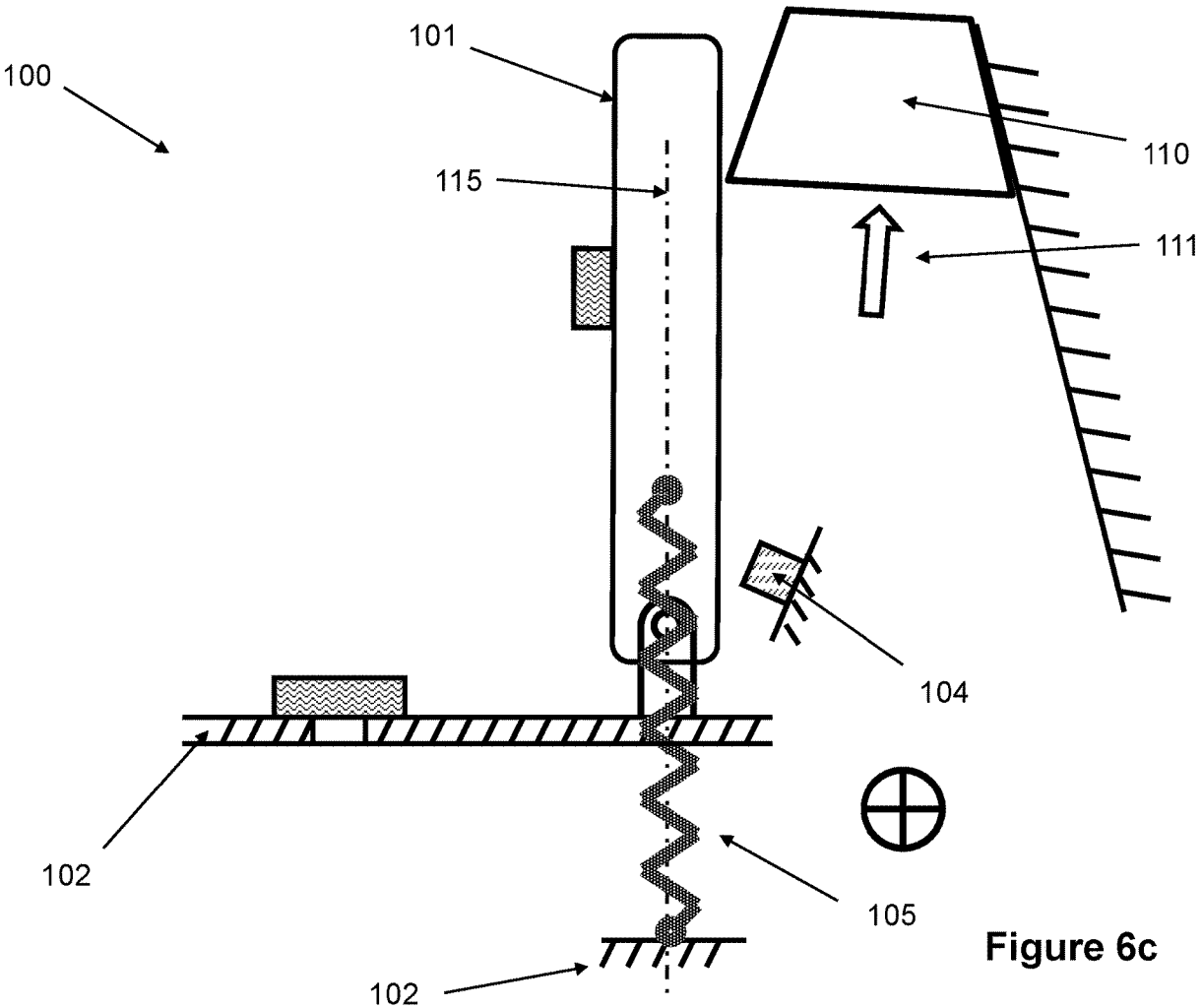
Figure 6D:
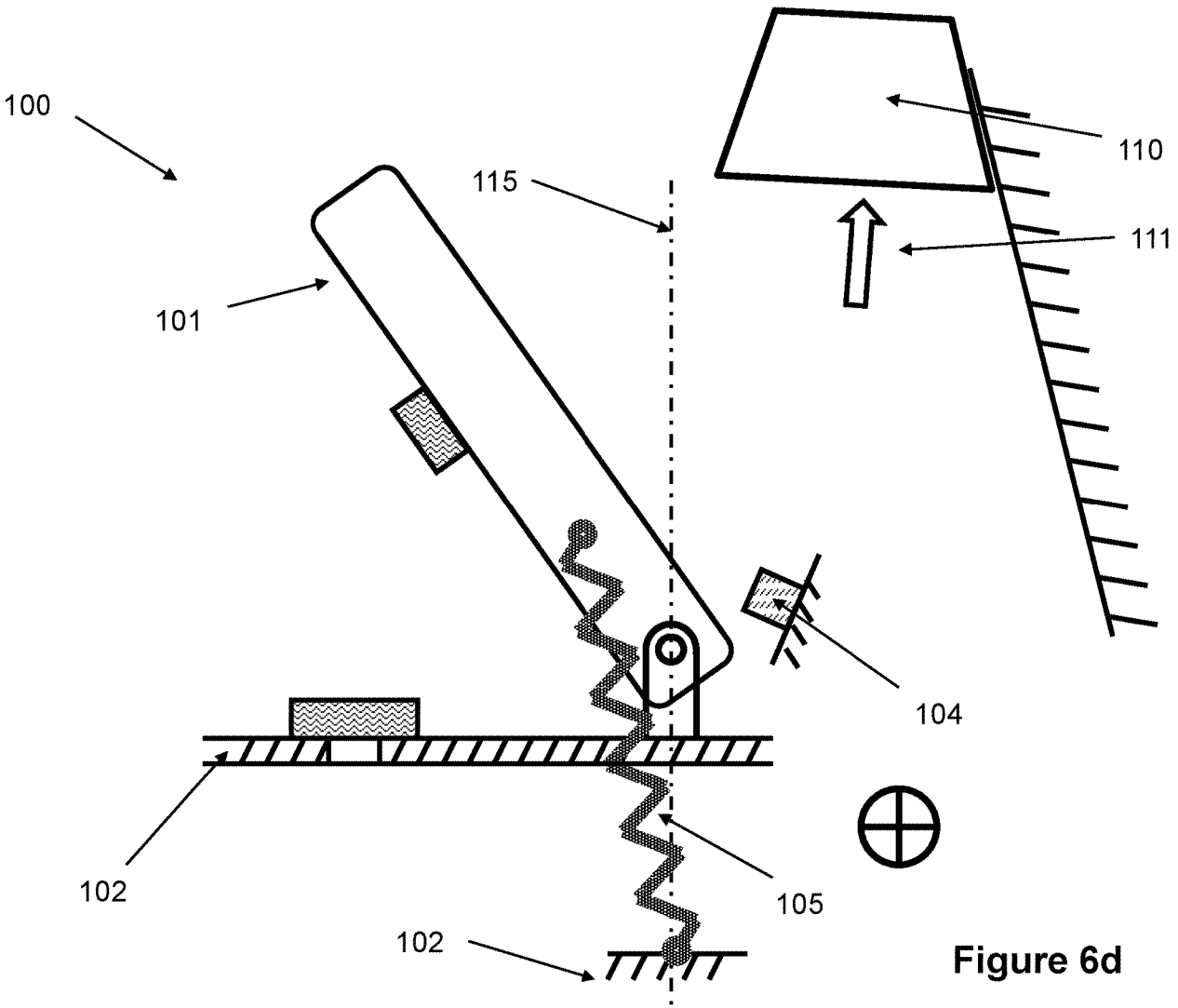
Figure 6E:
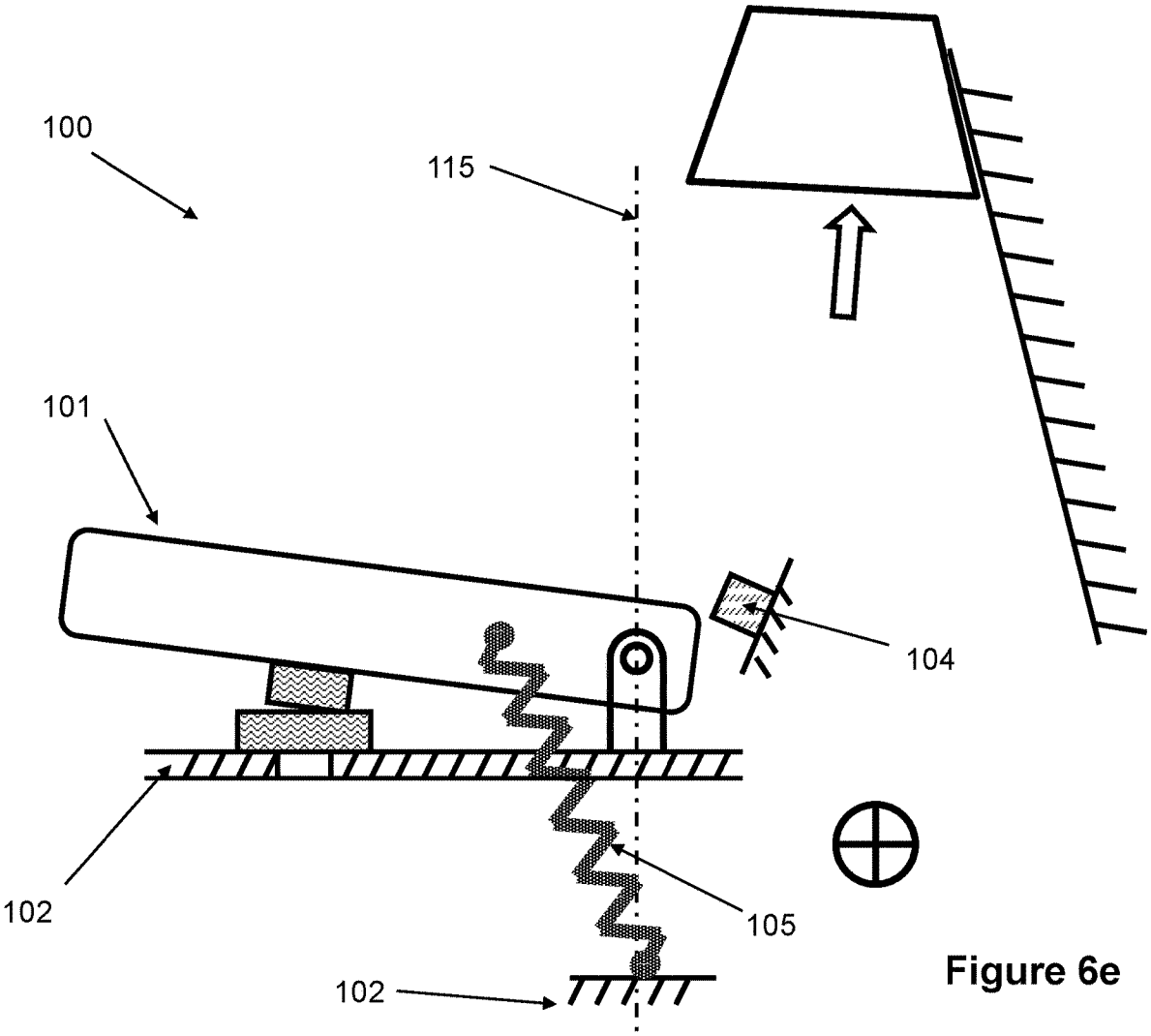

The operation of the embodiment 100 is as follows. At rest, the striker link 101 is biased to the right of the line 115 that passes through the pin joint 103 of the striker link 101 and the attachment point 107 of the spring 105, and leaving the striker link 101 attachment point 108 of the spring 105 to the right of the said line 115. When the munitions using the inertial igniter 100 is fired and begin to spin, the centripetal acceleration acts on the inertia of the element 110, generating a centrifugal force that will tend to push the element 110 in the direction of the arrow 111, against the surface 112 of the inertial igniter structure 102 and the side 113 of the striker link 101. If the munitions spin rate is high enough, it would generate a large enough centrifugal force on the element 110 in the direction of the arrow 111 to overcome the force exerted by the spring 105 on the striker link 101 to press it against the stop 104 and preventing it from rotating in the counterclockwise direction. As the aforementioned spin rate keeps increasing, the centrifugal force acting on the element 110 increases, thereby beginning to rotate the striker link 101 in the counterclockwise direction as shown in the schematic of FIG. 6*b*, until the attachment point 108 of the spring 105 reaches the line 115 as shown in FIG. 6*c*, i.e., until the toggle mechanism (striker) link 101 reaches its so-called singular position. With any further increase in the spin rate, the striker link 101 is further rotated in the counterclockwise direction and passes the aforementioned singular position, and the tensile force of the spring 105 will accelerate it rotationally in the counterclockwise direction (at least partially aided by further motion of the element 110 in the direction of the arrow 111) as shown in FIG. 6*d*. The striker link 101 will keep rotating in the counterclockwise direction with accelerating rate until the pyrotechnic components 114 and 106 impact and cause ignition. The latter state of the striker link 101 is shown in dashed lines in FIG. 6*e*.

The flames and sparks generated by the ignition of the pyrotechnic material 114 and 106 is then routed out from provided ports, usually through a hole such as the hole 120 to below the base to initiate the thermal material pyrotechnics. In some applications the flames and sparks are required to be routed from the side or from the top (opposite to the direction of exit from the hole 120) side of the inertial igniter 100.

It is noted that if the center of mass of the striker link 101 is away from the pin joint 103, then as the device spins, the resulting centripetal acceleration would act on the inertia of the striker link 101, generating a centrifugal force that would tend to rotate/keep the striker link 101 towards/at the aforementioned singular position shown in FIG. 6*c*. For this reason, the striker link 101 can be constructed such that its center of mass is located at the pin joint 103 or as close to it as possible.

In general, the tensile preloading of the spring 105 and the inertia (mass) of the element 110 are selected such that if the munitions in which the inertial igniter is installed is accidentally dropped (in the direction of accelerating the element 110 in the direction of the arrow 111) or if the said munitions is made to gain spin rates that falls below the all-fire spin, or in case of any specified accidental events, the resulting counterclockwise rotation of the striker link 101 would always be less than required to bring it to (even close) to its aforementioned singular position shown in the schematic of FIG. 6*c*. Then following any one of such accidental events, the preloaded spring 105 would force the striker link to return to its initial inactivated state shown in the schematic of FIG. 6*a*.

Figure 7A:
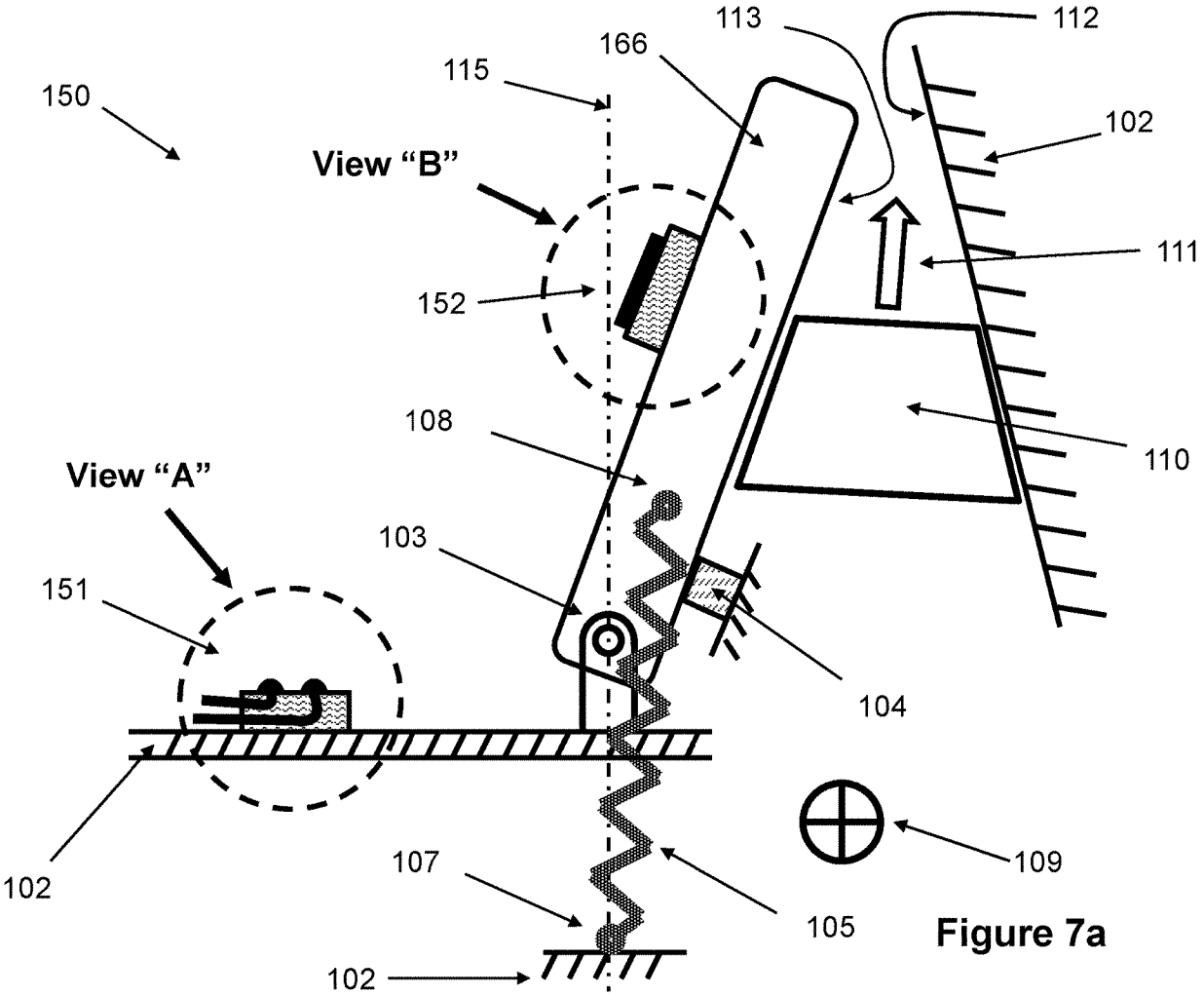
FIG. 7*a* illustrates a schematic of an electrical G-switch configured to close (open) when it is subjected to a prescribed spin rate.

The inertial igniter 100 can be readily modified to operate as a so-called electrical G-switch upon activation by the aforementioned all-fire spin rate would close (open) a normally open (closed) electrical circuit. One embodiment 150 such a G-switch is shown in the schematic of FIG. 7*a*. The construction and operation of the electrical G-switch is identical to those of the inertial igniter 100 of FIGS. 6*a*-6*d*, except that the pyrotechnic components 106 and 114 of the inertial igniter 100 is replaced by contact and circuit closing (opening) elements described below.

The schematic of the electrical G-switch 150 is shown in FIG. 7*a*. In this embodiment, the pyrotechnic component 114 of the inertial igniter 100 (FIG. 6*a*) is replaced with the contact element 151 and its pyrotechnic component (or striker pin) element 106 by the contact bridging element 152. All other elements of the G-switch 150 are indicated with the same numerals as the inertial igniter 100 of FIG. 6*a*.

Figure 1:
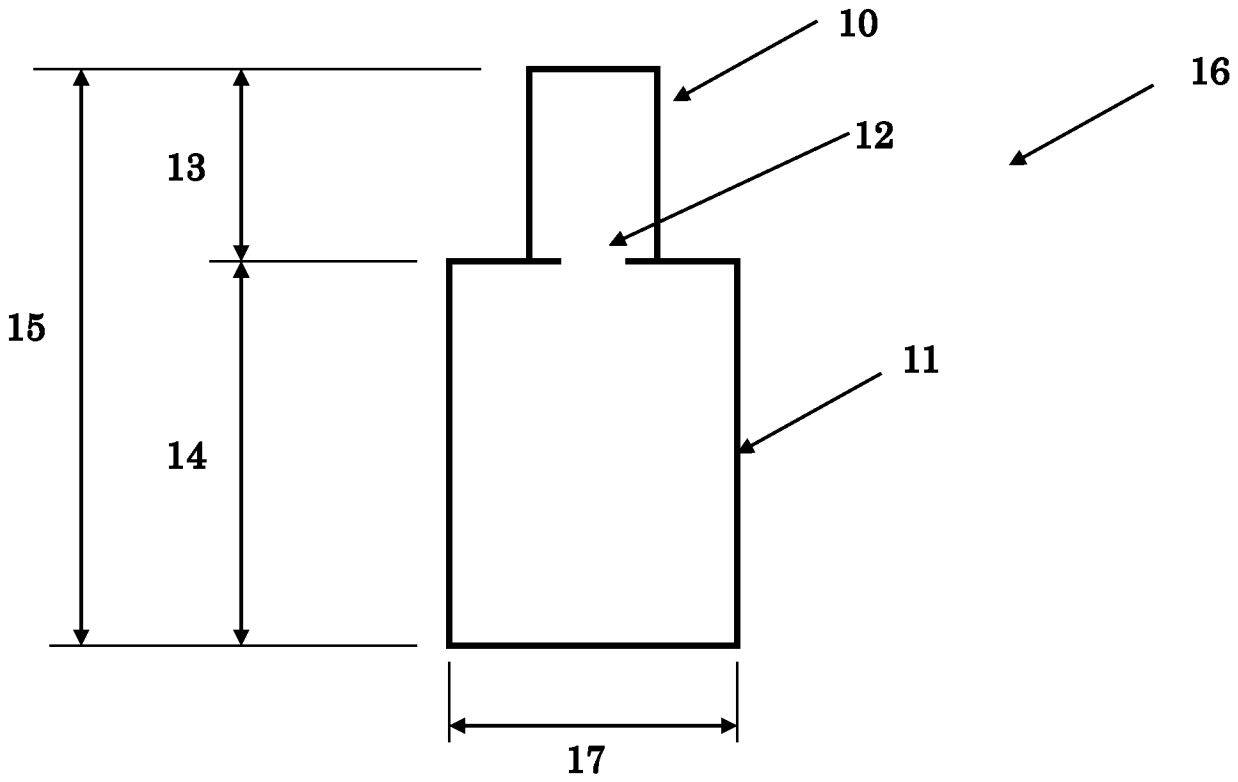
Figure 1 (Prior Art)
FIG. 1 illustrates a schematic of a cross-section of a thermal battery and inertial igniter assembly.

The close-up view "A" of the contact element 151 is shown in the schematic of FIG. 7*b*1. The contact element 151 is fixed to the structure 102 of the device and is constructed with at least two contacts 153 and 154, which are mounted on an electrically non-conductive base 157. The contact element 151 is also provided with conductive wires 155 and 156, which are connected to the contacts 153 and 154, respectively. The electrically conductive wires are passed through the electrically non-conductive base 157 as shown in FIG. 7*a* to prevent them from making contact.

Figure 7C:
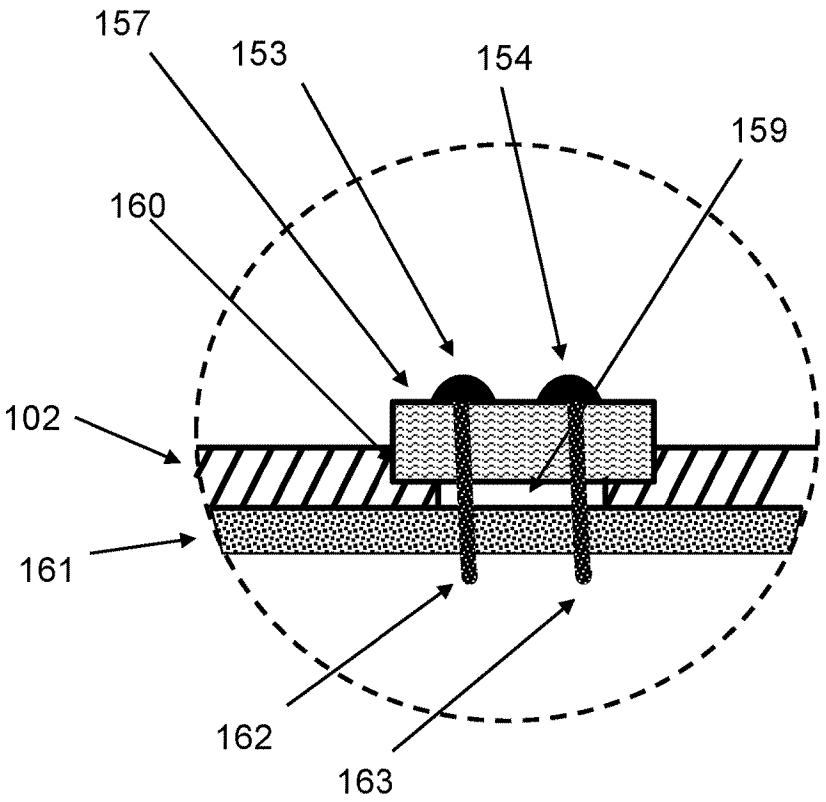

It is appreciated by those skilled in the art that if the structure 102 of the G-switch 150 is constructed with electrically conductive material, then the conductive wires 153 and 154 have to be routed out of the electrically non-conductive base 157 (from the side as shown in FIG. 7*a* or through a hole in the electrically conductive base of the structure 102—not shown in FIG. 7*a*). In applications in which the G-switch is attached, for example, to a printed circuit board 161 as shown in FIG. 7*c*, the electrically non-conducting base 157 is preferably mounted over a provided opening 159 in the structure 102 as shown in FIG. 7*c*, preferably in a provided recess 160, thereby allowing the contact wires 162 and 163 to pass through the provided opening 159 to reach the underlying element (in this case the printed circuit board 161). The wires can then be connected to the appropriate circuit provided over or bellow the circuit board 161—not shown).

Figure 2:
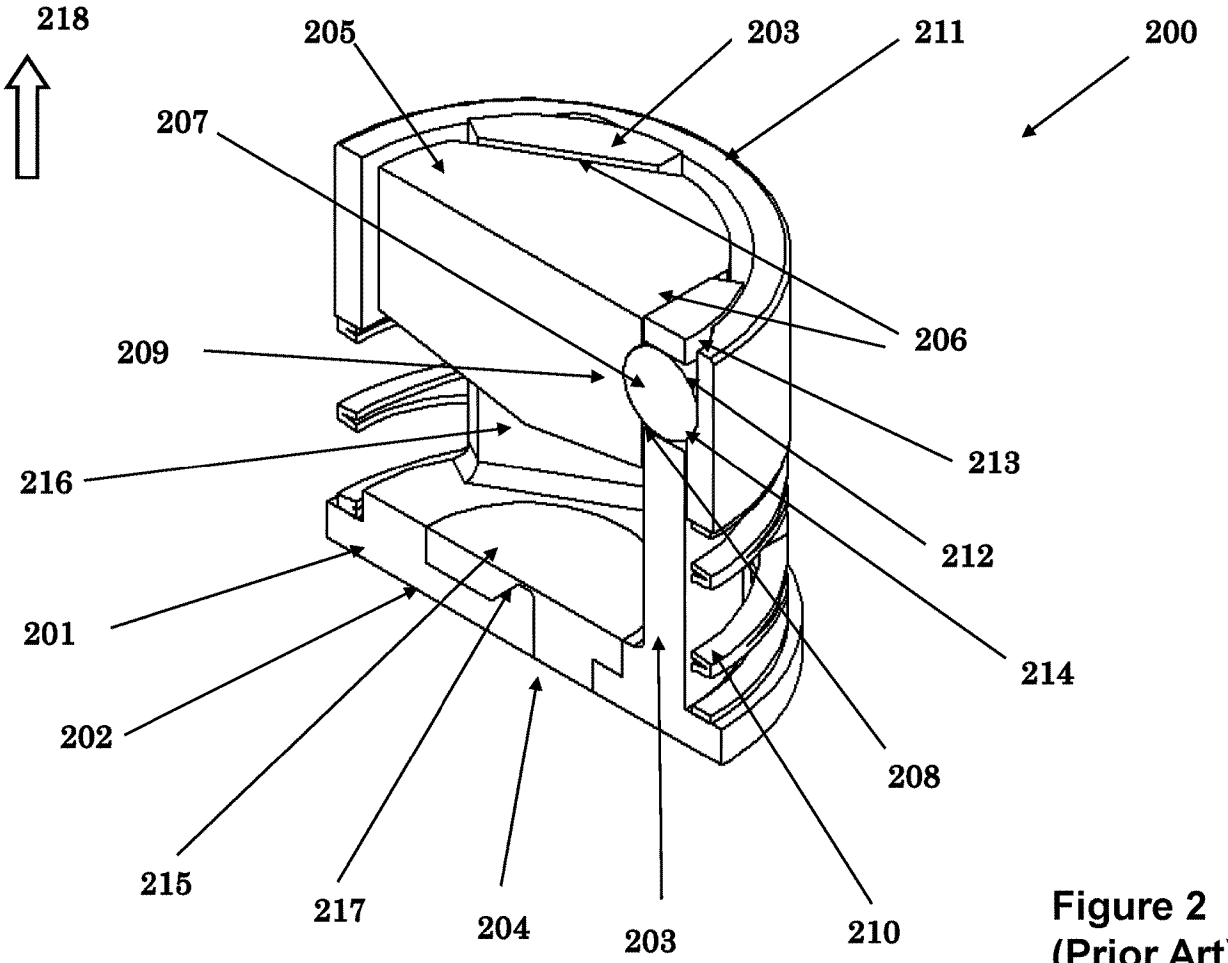
Figure 2 (Prior Art)
FIG. 2 illustrates a schematic of a cross-section of an inertial igniter for thermal battery described in the prior art.
Figure 3:
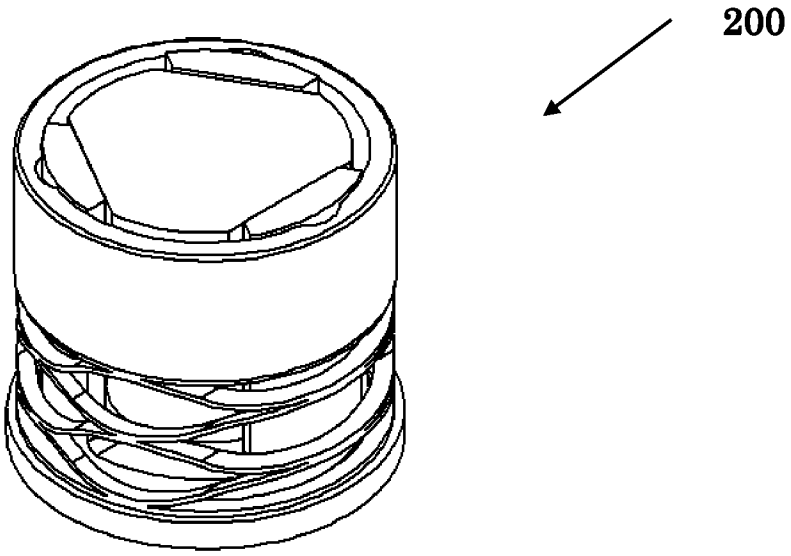
Figure 3 (Prior Art)
FIG. 3 illustrates a schematic of the isometric drawing of the inertial igniter for thermal battery of FIG. 2.
Figure 4B:
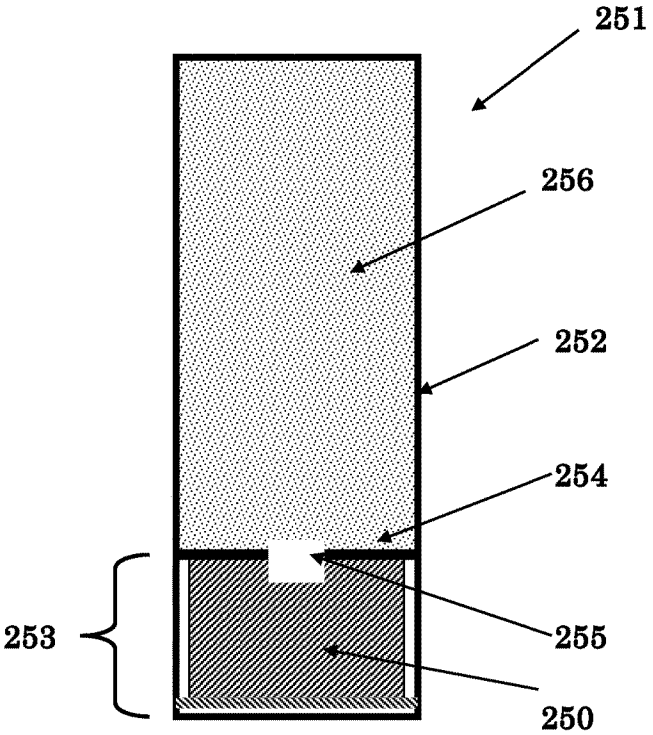
Figure 4b (Prior Art)
FIG. 4*b* illustrates a schematic of a cross-section of a thermal battery with an inertial igniter positioned on the bottom portion of the thermal battery and in which the ignition generated flame to be directed upwards into the thermal battery compartment.
Figure 4A:
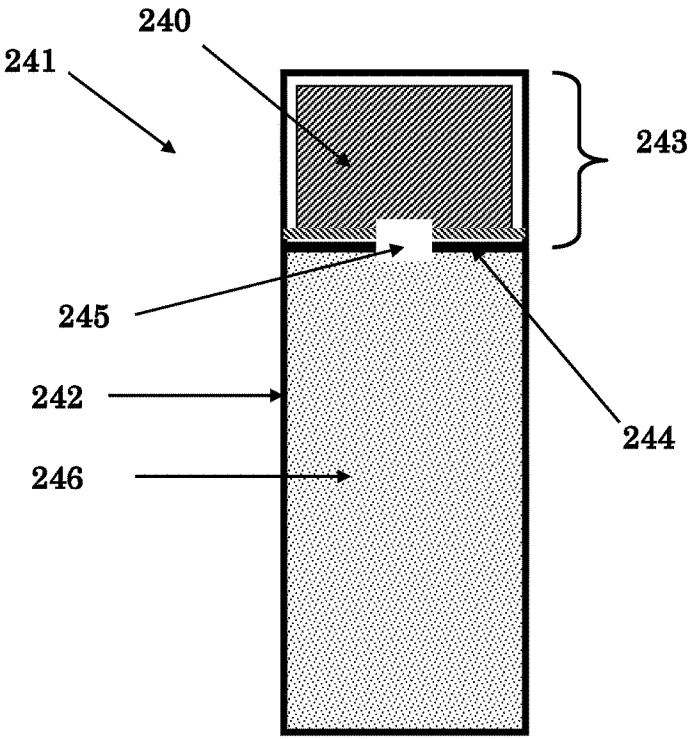
Figure 4a (Prior Art)
FIG. 4*a* illustrates a schematic of a cross-section of a thermal battery with an inertial igniter positioned on the top portion of the thermal battery and in which the ignition generated flame to be directed downwards into the thermal battery compartment.
Figure 5:
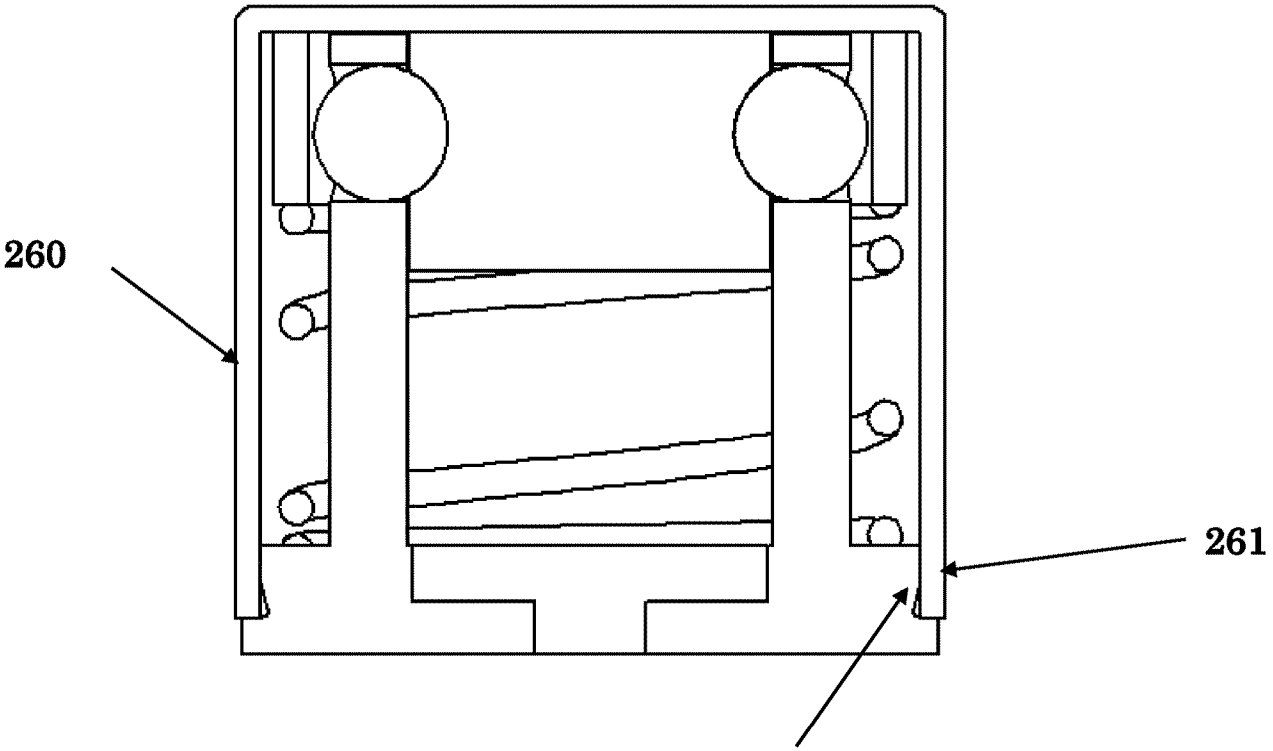
Figure 5 (Prior Art)
FIG. 5 illustrates a schematic of cross-section of an inertial igniter for thermal battery described in prior art with an outer housing.

The close-up view "B" of the contact element 152, FIG. 7*a*, is also shown schematically in FIG. 7*b*2. The contact element 152 consists of an electrically non-conductive base 165, which is fixed to the surface of the link 166 (101 in the inertial igniter 100 of FIG. 6*a*) as shown in FIG. 7*a*. An electrically conductive contact strip 164 (which can be relatively thin and flexible) is mounted on the surface of the electrically non-conductive base 165.

Figure 7D:
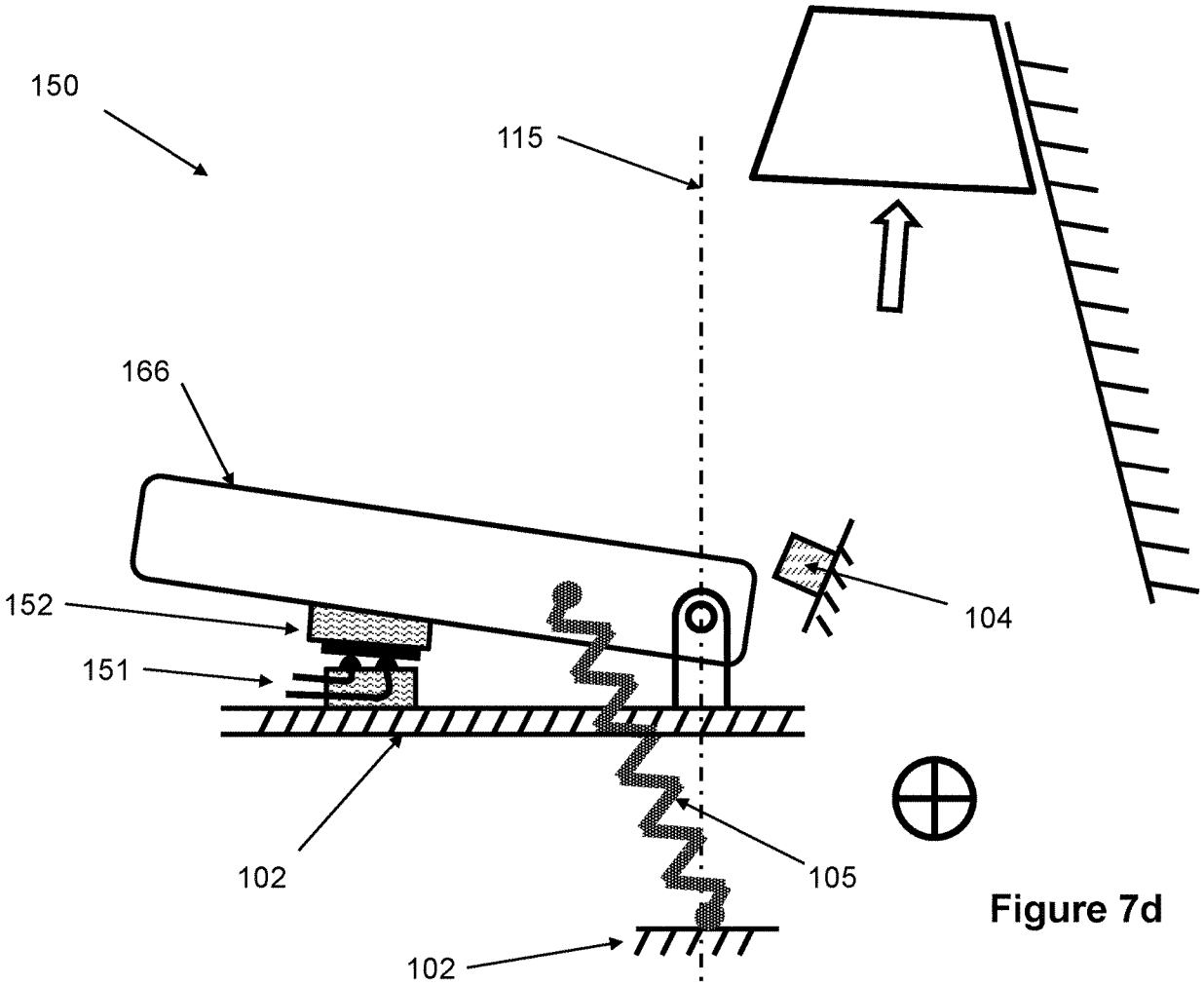
FIG. 7*d* illustrates the schematic of the electrical G-switch of FIG. 7*a* in its activated configuration.

The electrical G-switch 150 operates in a manner similar to the inertial igniter 100 of FIG. 6*a*-6*e*, i.e., as the aforementioned spin rate is increased and reaches certain predetermined threshold, the link 166 begins to rotate in the counterclockwise direction. As the spin rate is further increased, the link 166 rotates further in the counterclockwise direction, until at a predetermined spin rate, the link 166 reaches its aforementioned singular position (as shown for the striker link 100 in the schematic of FIG. 6*c*). With further increase in the spin rate, the striker link 166 is further rotated in the counterclockwise direction and passes its aforementioned singular position, and the tensile force of the spring 105 will accelerate it rotationally in the counterclockwise direction (at least partially aided by further motion of the element 110 in the direction of the arrow 111) as shown in FIG. 6*d* for the inertial igniter 100. The link 166 will then keep rotating in the counterclockwise direction with accelerating rate until the contact strip 164 of the contact element 152 comes into contact with the contacts 153 and 154 of the contact element 151 as shown in the schematic of FIG. 7*d*. As a result, the wires 155 and 156 are connected electrically, and the circuit to which they are connected is closed.

It is appreciated by those skilled in the art that more than two contacts 153 and 154 may be provided on the contact element 151, thereby allowing the electrically conductive strip 164 of the contact element 152 to close more than one electrical circuit (when using pairs of contacts 153 and 154 and electrically isolated electrically conductive strips 164 on the contact elements 151 and 152, respectively) or allowing at least three contacts (similar to contacts 153 and 154) on the contact element 151 to form a junction by an electrically conductive strip 164.

The electrical G-switch 150 of FIG. 7*a* is designed for closing an electrical circuit once the G-switch is activated. Alternatively, the electrical G-switch 150 can be designed for opening an already closed electrical circuit by replacing the pair of contact elements 151 and 152 shown in FIGS. 7*b*1 and 7*b*2. In such an alternative embodiment of the present invention, the alternative pair of contact elements may be constructed in many different configurations. As an example, the contact elements 151 and 152 may be replaced by alternative contact elements 171 and 172, respectively, which are shown in the close-up views "C" and "D" in the schematics of FIGS. 8*a* and 8*b*.

Figure 8B:
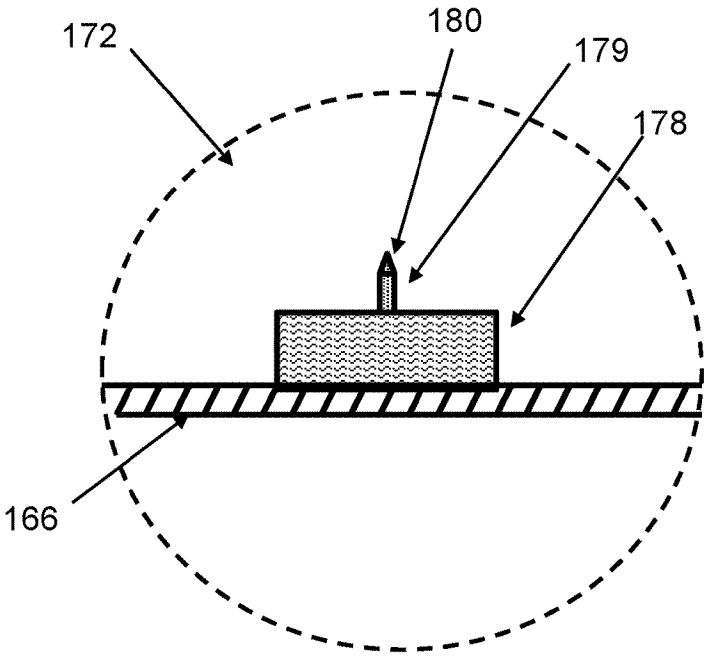
FIGS. 8*a* and 8*b* illustrate the schematic of details of general configuration of the contact elements of a normally closed version of the electrical G-switch of FIG. 7*a*.
Figure 8A:
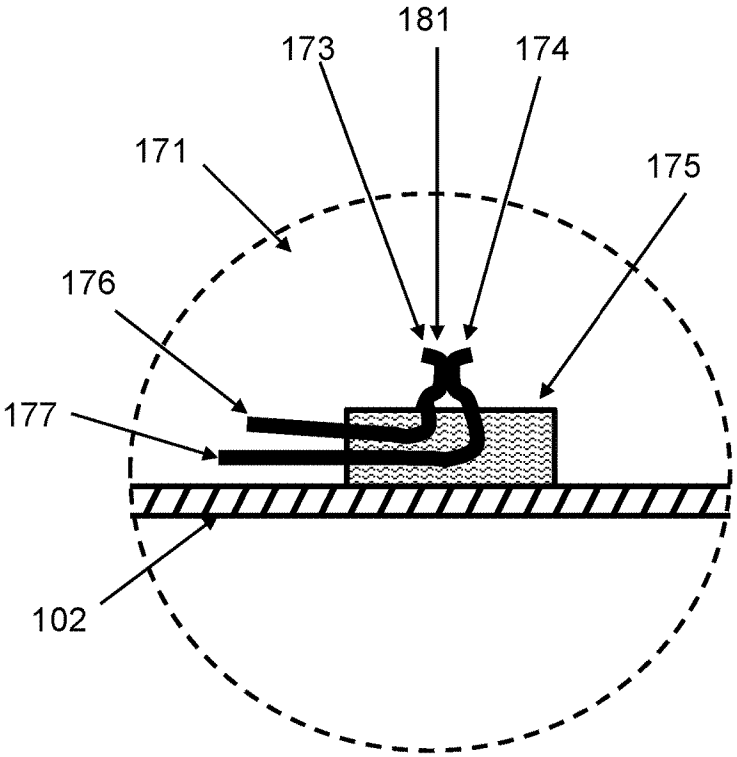

As can be seen in the close-up view "C" of FIG. 8*a*, the contact element 171 is fixed to the structure 102 of the electrical G-switch, and is constructed with at least two electrical contacts 173 and 174, which are mounted on an electrically non-conductive base 175. The electrical contacts 173 and 174 are fabricated of electrically conductive material commonly used in electrical contacts, are configured such that they are normally in contact as shown in FIG. 8*a*, and can be relatively flexible so that they could be pushed apart the required amount without causing them to permanently deform, i.e., such that they would return to their contacting configuration after separation of a relatively small amount as described below for their proper operation as a normally closed G-switch. The contact element 171 is also provided with conductive wires 176 and 177, which are connected to the contacts 173 and 174, respectively. The electrically conductive wires are passed through the electrically non-conductive base 175 as shown in FIG. 8*a* to prevent them from making contact.

It is appreciated by those skilled in the art that as described for the normally open G-switch embodiment 150 of FIG. 7*a*, if the structure 102 of the G-switch is constructed with electrically conductive material, then the conductive wires 176 and 177 have to be routed out of the electrically non-conductive base 175 (from the side as shown in FIG. 8*a* or through a hole in the electrically conductive base of the structure 102—not shown in FIG. 8*a*). In applications in which the G-switch is attached, for example, to a printed circuit board 161 as shown in FIG. 7*c* for the contact element, the electrically non-conducting base 175 (157 in FIG. 7*c*) can be mounted over a provided opening (similar to the opening 159 in FIG. 7*c*) in the structure 102 as shown in FIG. 7*c*, such as in a provided recess 160, thereby allowing the contact wires 176 and 177 (wires 162 and 163 in FIG. 7*c*) to pass through the provided opening 159 to reach the underlying element (in this case the printed circuit board 161). The wires can then be connected to the appropriate circuit provided over or bellow the circuit board 161—not shown).

The close-up view "D" of the contact element 172 is shown schematically in FIG. 8*b*. The contact element 172 consists of an electrically non-conductive base 178, which is fixed to the surface of the link 166 (FIG. 7*a*) as shown in FIG. 8*b*. An electrically no-conductive (preferably relatively thin but rigid) plate 179 is mounted on the surface of the electrically non-conductive base 178. The tip 180 of the electrically non-conductive plate can be relatively sharp to facilitate insertion between the contacts 173 and 174 during the G-switch activation as described below.

Figure 8C:
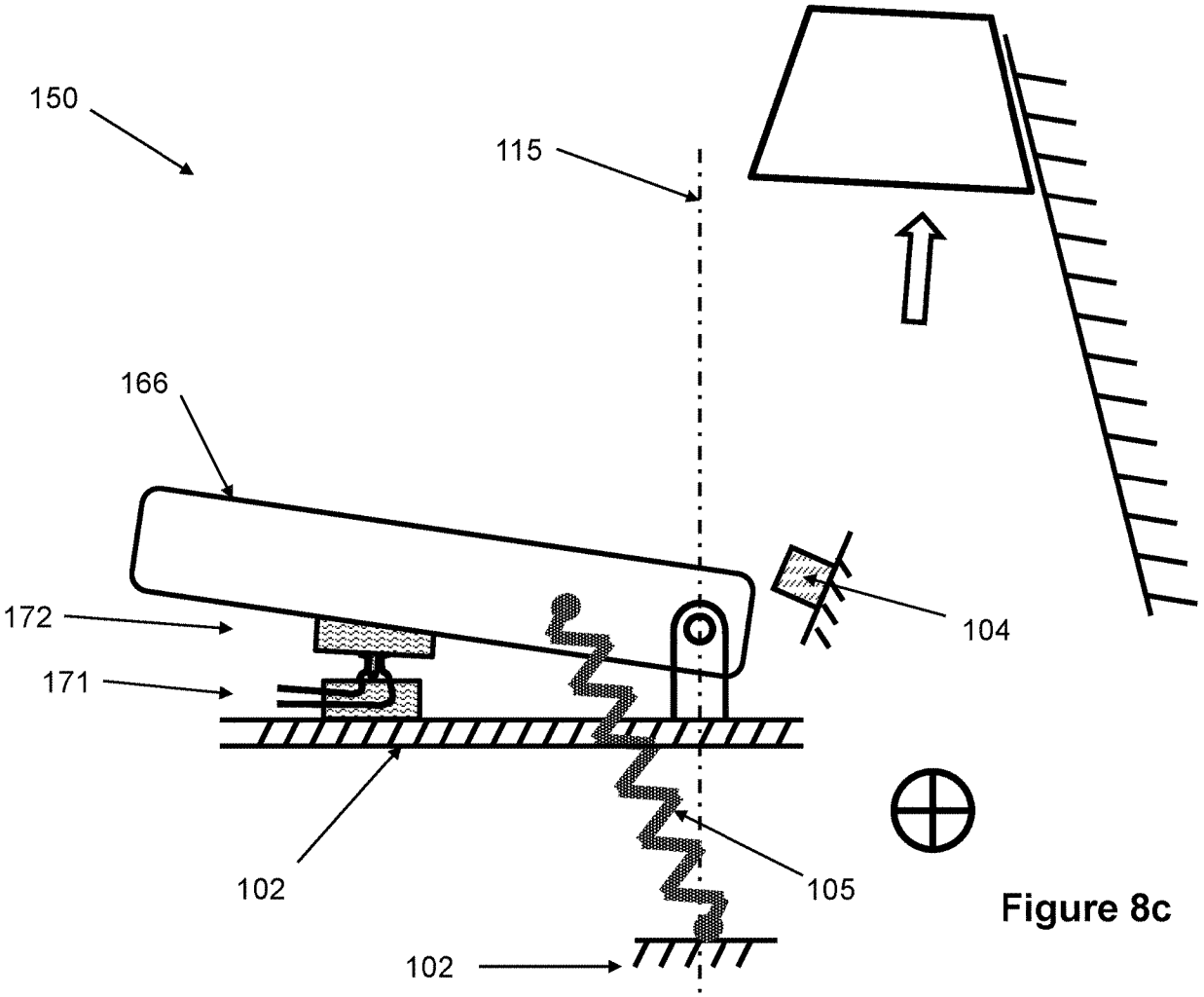
FIG. 8*c* illustrates the schematic of the electrical G-switch of FIG. 8*a* in its activated configuration.

The electrical G-switch 150 with the normally closed contacts 171 and 172 operates in a manner similar to the aforementioned normally open G-switch shown in FIGS. 7*a* and 7*d*, i.e., as the aforementioned spin rate is increased and reaches certain predetermined threshold, the link 166 begins to rotate in the counterclockwise direction. As the spin rate is further increased, the link 166 rotates further in the counterclockwise direction, until at a predetermined spin rate, the link 166 reaches its aforementioned singular position (as shown for the striker link 100 in the schematic of FIG. 6*c*). With further increase in the spin rate, the striker link 166 is further rotated in the counterclockwise direction and passes its aforementioned singular position, and the tensile force of the spring 105 will accelerate it rotationally in the counterclockwise direction (at least partially aided by further motion of the element 110 in the direction of the arrow 111) as shown in FIG. 6*d* for the inertial igniter 100. The link 166 will then keep rotating in the counterclockwise direction with accelerating rate until the tip 180 of the electrically non-conductive plate 179 is wedged in the space 181 between the contacts 173 and 174; spreads the contacting surfaces of the contacts 173 and 174 apart; and is inserted between the contacts 173 and 174 as shown in the schematic of FIG. 8*c*. As a result, the contact between the contacts 173 and 174 is interrupted, and the circuit connected to the wires 176 and 177 is opened.

It is appreciated by those skilled in the art that the spin rate that is required to achieve activation of the inertial igniter 100 of FIG. 6*a*-6*e* and electrical G-switches 150 of FIGS. 7*a*-7*d* and 8*a*-8*c* can be varied by varying the inertia and geometry of the element 110, the angles between the surface 112 of the structure 102 of the device and the surface 113 of the link 101 as seen in the schematic of FIG. 6*a*. In addition, the surfaces 112 and 113 as well as the contacting surfaces of the element 110 may be formed as curved to achieve the desired levels of counterclockwise rotation of the link 101 as the element 110 moves in the direction of the arrow 111. In this manner, the contact force and direction on the contacting surfaces between the element 110 and the surface 113 of the link 101 as well as between the element 110 and the surface 112 of the device structure 102 can be controlled as is done in the design of cam and follower surfaces.

It is also appreciated by those skilled in the art that the element 110 of the inertial igniter 100 of FIG. 6*a*-6*e* and electrical G-switches 150 of FIGS. 7*a*-7*d* and 8*a*-8*c* may be provided with a spring 190 (shown in dashed lines in FIG. 6*a*) to provide a preloading force on the element 110 for the purpose of assisting the aforementioned centrifugal force that tends to move it in the direction of the arrow 111 as the device spins about the axis 109 (in which case, the spring 190 is preloaded in compression). A preloading of the spring 190 in tension would provide a force that counters the centrifugal force that tends to move it in the direction of the arrow 111 as the device spins about the axis 109.

It is also appreciated by those skilled in the art that the stop 104 may be positioned such that any desired angle 191 (FIG. 6*a*) of the link 101 from its aforementioned singular position (shown in FIG. 6*c*), i.e., from the line 115, can result. As a result, the amount of counterclockwise rotation that the link 101 has to undergo before it passes its singular position and activate the device can be controlled. As a result, and particularly by providing the element 110 with a spring 190 that is preloaded in compression, the spin rate at which the device is activated can be reduced.

It is also appreciated by those skilled in the art that with a compressively preloaded spring 190, the amount of torque (moment of the force applied by the element 110 to the link 101 about the pin joint 103) required to rotate the link counterclockwise to its said singular position (FIG. 6*c*) is determined by the opposing torques that the springs 105 and 190 apply to the link 101. As a result, for a given device, by increasing the level of compressive preloading of the spring 190, the tensile preloading of the spring 105 can be increased for a given device activation spin rate. As a result, the potential energy stored in the spring 105 increased, thereby increasing the kinetic energy of the striker link 101 as the pyrotechnic components 106 and 114 impact. This capability of the inertial igniter embodiment 100 and G-switch embodiment 150 is particularly important in applications in which the spin rate of the munitions using these devices is relatively low.

It is also appreciated by those familiar with the art that by moving the attachment point 107 of the spring 105 to the device structure 102 to the right or to the left, the amount of counterclockwise rotation of the link 101 that is required to bring it to its new aforementioned singular position is changed. For example, by moving the attachment point 107 to the right, the angle is increased (the line 115 is rotated counterclockwise, thereby increasing the angle 191 of the link 101 to the line 115, i.e., to its singular position).

The spin rate that is required to achieve activation of the inertial igniter 100 of FIG. 6*a*-6*e* and electrical G-switches 150 of FIGS. 7*a*-7*d* and 8*a*-8*c* can be varied by varying the inertia and geometry of the element 110, the angles between the surface 112 of the structure 102 of the device and the surface 113 of the link 101 as seen in the schematic of FIG. 6*a*. In addition, the said surfaces 112 and 113 as well as the contacting surfaces of the element 110 may be formed as curved to achieve the desired levels of counterclockwise rotation of the link 101 as the element 110 moves in the direction of the arrow 111. In this manner, the contact force and direction on the contacting surfaces between the element 110 and the surface 113 of the link 101 as well as between the element 110 and the surface 112 of the device structure 102 can be controlled as is done in the design of cam and follower surfaces.

With a compressively preloaded spring 190, the amount of torque required to rotate the link counterclockwise to its said singular position (FIG. 6*c*) is determined by the opposing torques that the springs 105 and 190 apply to the link 101. As a result, for a given device, by increasing the level of compressive preloading of the spring 190, the tensile preloading of the spring 105 can be increased for a given device activation spin rate. As a result, the potential energy stored in the spring 105 increased, thereby increasing the kinetic energy of the striker link 101 as the pyrotechnic components 106 and 114 impact. This capability of the inertial igniter embodiment 100 and G-switch embodiment 150 is particularly important in applications in which the spin rate of the munitions using these devices is relatively low.

Figure 9A:
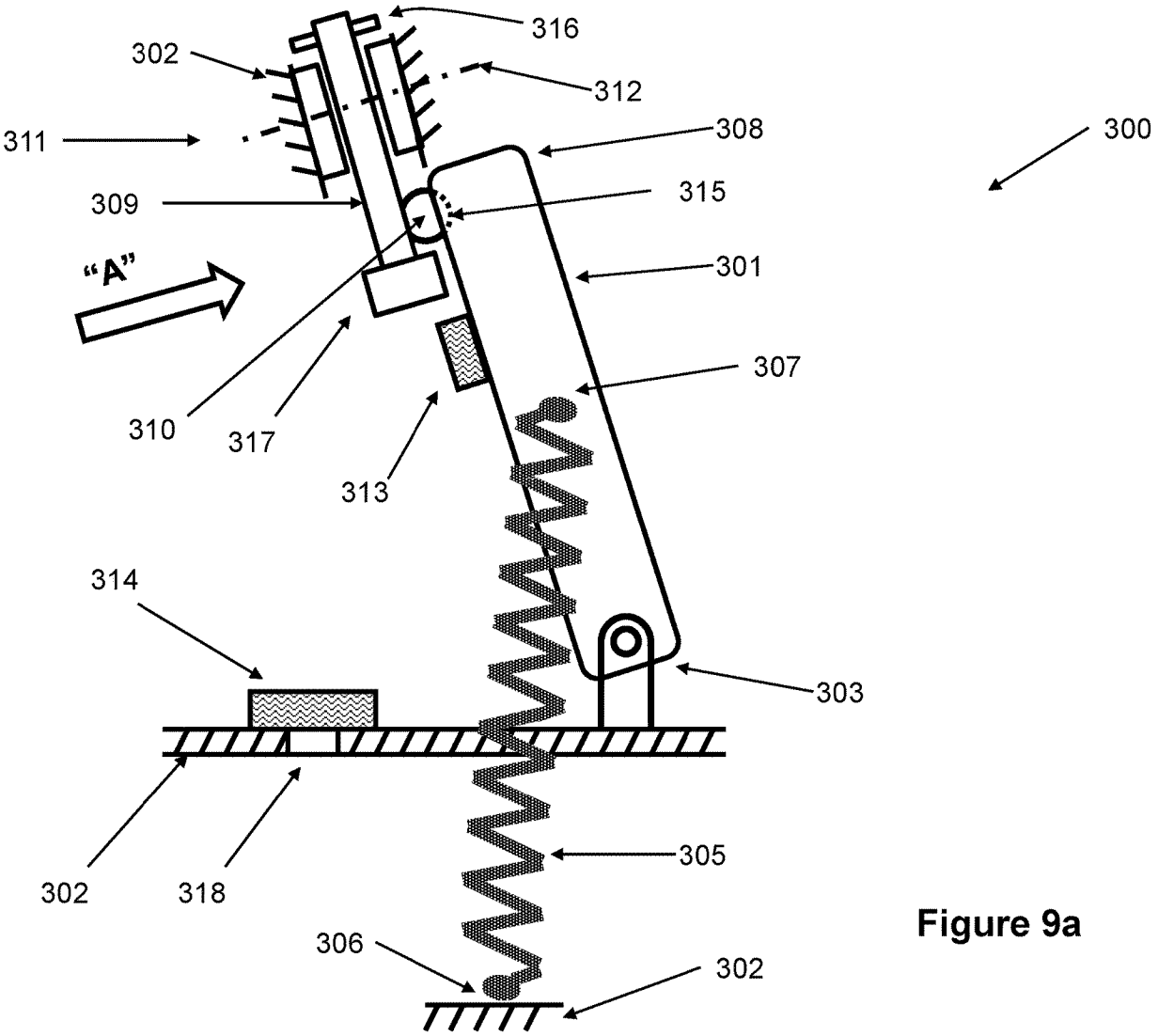
FIG. 9*a* illustrates a schematic of another embodiment of an inertia igniter configured to initiate pyrotechnic materials when subjected all-fire axial (setback) accelerations of relatively low amplitude and/or low duration.

Another embodiment 300 of the present inertia igniter invention is shown in the schematic of FIG. 9*a*. In this embodiment, the striker component of the inertial igniter 300 is the striker link 301, which is attached to the structure of the inertial igniter 302, by a pin joint indicated with numeral 303. A spring 305, which can be preloaded in tension, is attached to the structure of the inertial igniter 302 on the end 306 and to the striker link 301 on the other end 307, preferably with pin or pin-like joints. In its pre-activation state shown in FIG. 9*a*, the striker link 301 is pressed (such as near its tip 308) against a rotating link 309, through an intermediate ball 310. The link 309 is attached to the structure of the inertial igniter 302 via a rotary joint 311, which allows it to rotate about the axis 312. The axis 312 is parallel to the plane of view of FIG. 9*a*, thereby allowing the link 309 to rotate up or down relative to the plane of the rotation of striker link 301. A mass 317 is attached to the tip of the link 309. The mass 317 may be required to be added if the center of mass of the link 309 is not on the side of the striker link 301 or if it is relatively low to properly operate the inertial igniter as described later in this disclosure. The latter becomes particularly the case when the setback acceleration level is relatively low. The elements 313 and 314, fixed to the striker link 301 and the inertial igniter structure 302, respectively, are the two components of the ignition pyrotechnic. Alternatively, a one piece pyrotechnic element may be used, in which case the element 313 can be the ignition impact mass or pin and the element 314 can be the one piece impact initiated pyrotechnic element.

In general, a relatively shallow "dimple" 315 is provided on the surface of the striker link 301 to seat the ball 310 so that the ball 310 is prevented from sliding out from between the link 309 and the striker link 301. The tensile force applied to the striker link 301 is seen to generate a torque that tends to rotate the striker link 301 in the counterclockwise direction, thereby pressing the ball 301 against the surface of the link 309. The link 309 can be provided with a stop 316 under it as shown in FIG. 9*a* (or above the ball 310 contact side of the link 309) to prevent its ball contacting end from significantly moving up and loose contact with the ball 310. The link 309 is also provided with a biasing compressive spring 331 shown in the side view "A" of FIG. 9*c*, which tends to rotate its ball contacting end up, thereby pressing its opposite end against the stop 316. In practice, the spring 331 can be a torsion spring.

The inertial igniter 300 is intended to be initiated by setback acceleration, which is considered to be in the direction perpendicular to the plane of the rotation of the striker link 301 (the plane of the FIG. 9*a*) and directed upwards (outward from the said plane of the rotation of the striker link 301). In particular, the inertial igniter 300 is intended to be initiated by setback accelerations that are either relatively low level or are relatively short in duration or both relatively low level and relatively short duration. In such applications, the setback acceleration is not long enough in duration to actuate a release mechanism, which is required for safety reasons to prevent accidental initiation, as well as accelerate a striker mass long enough to provide it with enough mechanical energy to achieve ignition of pyrotechnic materials of the inertial igniter upon the previously described pyrotechnic impact (between a two part pyrotechnic components, a pin impacting a one-part pyrotechnic material, a pin impacting a percussion cap, or the like).

Figure 9B:
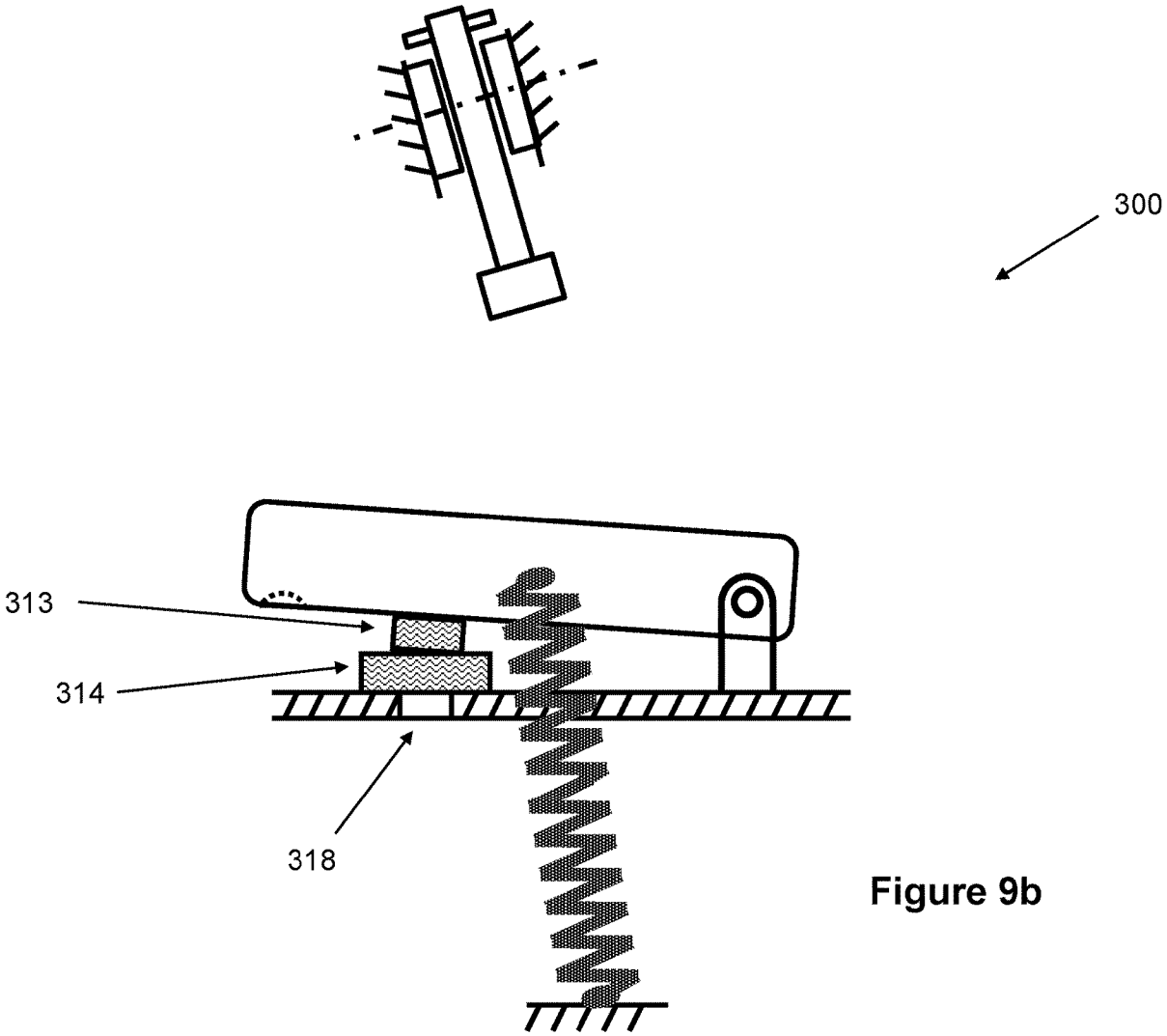
FIG. 9*b* illustrates the inertia igniter of FIG. 9*a* in its activated configuration following an all-fire setback acceleration.
Figure 9C:
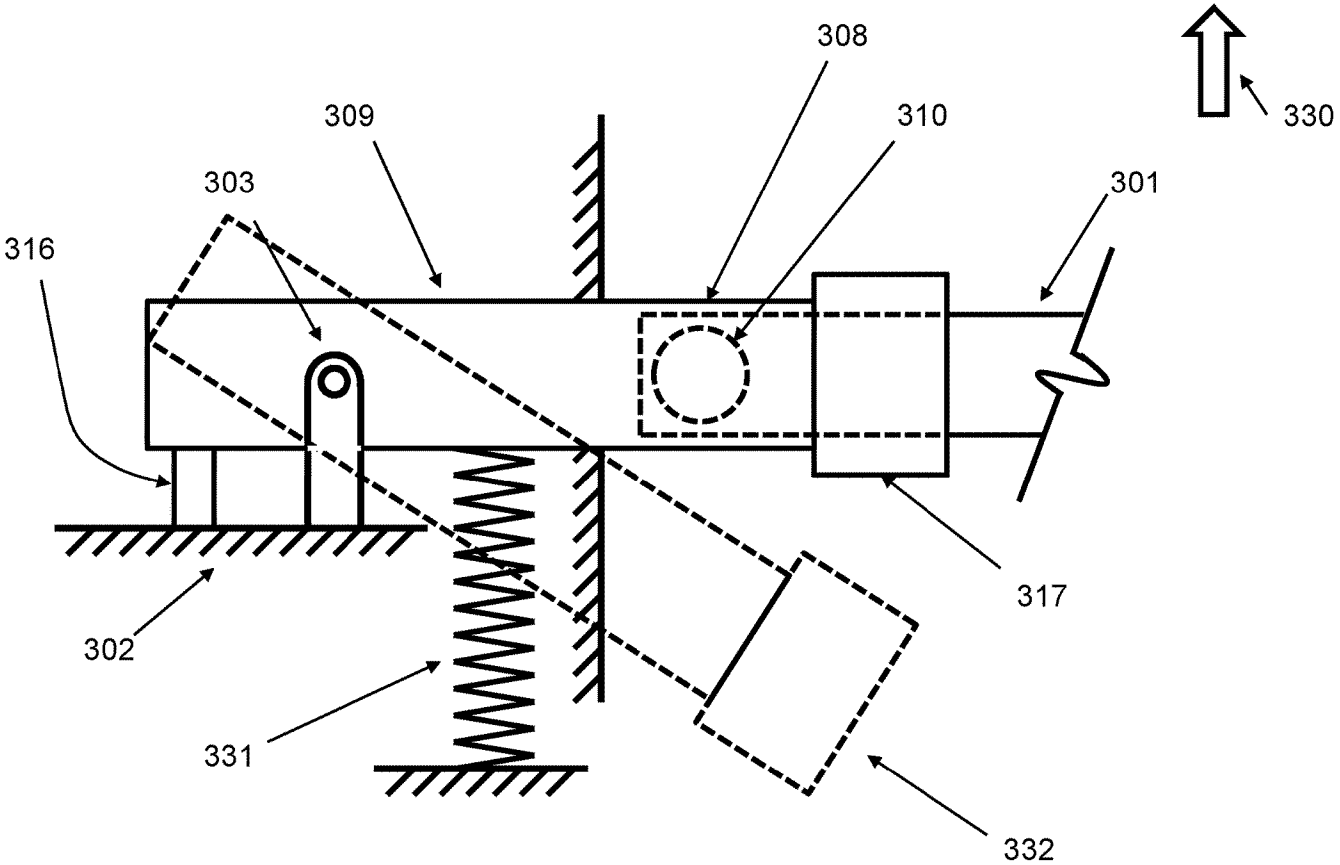
FIGS. 9*c*-9*d* illustrate view "A" of FIG. 9*a*, showing the operation of the striker link release mechanism of the inertia igniter of FIG. 9*a*.

The operation of the embodiment 300 is as follows. At rest, the tip 308 of the striker link 301 is pressed against the link 309 through the ball 310 by the tensile force of the preloaded spring 305 acting on the striker link 301 as can be seen in the schematic of FIG. 9*a*. When the munitions using the inertial igniter 300 is fired, the setback acceleration (in the direction of the arrow 330 shown in FIG. 9*c*, which is perpendicular to the plane of the inertial igniter 300, i.e., the plane of FIG. 9*a*) will cause the mass 317 to be pushed down. As the tip of the link 309 (with the mass 317) moves down, the surface of the link 309 that is in contact with the ball 310 slides pass the ball 310, and when it has moved down enough and passed the ball 310, it is designed to have also moved passed the bottom surface of the striker link 301, thereby clearing the striker link 301 to be released. In FIG. 9*c*, the positions of the link 309 and mass 317 after the application of said setback acceleration and its said downward motion to clear the striker link 301 is shown in dashed lines and indicated by the numeral 332. The tensile force of the spring 305 will then accelerate the striker link 301 rotationally in the counterclockwise direction until the pyrotechnic components 313 and 314 impact and cause ignition. The latter state of the striker link 301 is shown in FIG. 9*b*. The flames and sparks generated by the ignition of the pyrotechnic material 313 and 314 is then routed out from provided ports, usually through a hole such as the hole 318 to below the base to initiate the thermal material pyrotechnics. In some applications, the generated flames and sparks are required to be routed from the side or from the top (opposite to the direction of exit from the hole 318) side of the inertial igniter 300.

It is appreciated by those skilled in the art that the inertial igniter 300 can still operate without the use of the intermediate ball 310 being present between the striker link 301 (such as near the tip 308) and the rotating link 309. However, the inertial igniter 300 can be constructed with such an intermediate rolling element to minimize the friction forces between the striker link 310 and the rotating link 309. In general, it is desired that the friction forces be as small as possible so that the (downward) force that the setback acceleration needs to generate while acting on the inertia (mass 317) to rotate the rotating link 309 down to release the striker link 301 is minimized. By minimizing the required downward setback acceleration generated force, the inertia of the required mass 317, i.e., the size of the required mass 317, is minimized.

It is appreciated by those skilled in the art that the aforementioned biasing (torsion) spring of the link 309 is selected such that in the case of accidental drops or other similar accidental (no-fire) events, the link 309 is not rotated downwards enough for the link 309 to clear the ball 310, i.e., to release the striker link 301.

It is also appreciated by those skilled in the art that the spring 305 may be a compressive spring preloaded in compression in the configuration of the inertial igniter shown in the schematic of FIG. 9*a*. Such a compressively preloaded spring 305 needs to be positioned above the striker link 301 as viewed in the schematic of FIG. 9*a*, so that it would apply a preloading counterclockwise torque to the striker link 301 which would allow the inertial igniter 300 to operate as previously described for the tensile spring 305. Alternatively, the spring 305 may be a torsion spring, which can be positioned at the pin joint 303, and preloaded in the clockwise direction so that in the configuration shown in the schematic of FIG. 9*a*, it would apply a counterclockwise torque to the striker link 301 which would allow the inertial igniter 300 to operate as previously described for the tensile spring 305.

Figure 9D:
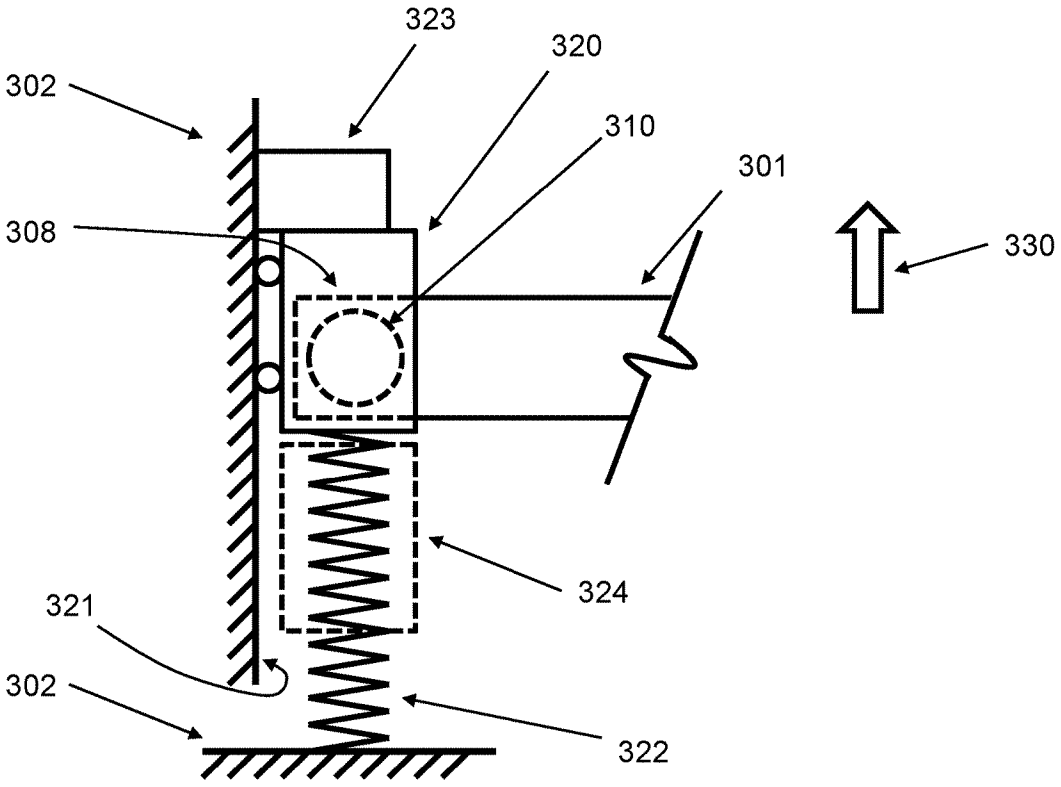

It is also appreciated by those familiar with the art that in an alternative embodiment of the inertial igniter 300, FIG. 9*a*, the rotating link 309 may be replaced by a translating element 320, as shown in the FIG. 9*d* of the appropriately modified side view "A" of FIG. 9*a*. In this alternative embodiment, the link 309 and its rotary joint 311 are replaced with the translating element 320, which is designed to translate in the guide 321 (sidewalls of the guide to prevent lateral displacement of the translating element 320 not shown for clarity—the guide may also be provided with friction reducing coated surfaced and/or rolling elements such as balls or rolling needles—not shown), which is in turn attached to the inertial igniter structure 302. The translating element 320 is also provided with a compressive biasing spring 322, which at rest would keep the translating element 320 in the configuration shown in solid lines against the stop 323. As was previously described for the embodiment of FIG. 9*a*, the tensile force applied to the striker link 301 by the spring 305 generates a torque that tends to rotate the striker link 301 in the counterclockwise direction, thereby pressing the ball 301 against the surface of the translating element 320. In its pre-activation state shown in FIG. 9*a*, the striker link 301 is pressed (preferably near the tip 308) against the translating element 320, through an intermediate ball 310, FIG. 9*d*. Depending on the level of setback acceleration, i.e., if it is relatively low, then the mass of the translating element 320 may have to be increased by increasing its size and/or material density.

The inertial igniter 300 embodiment with the translating element 320 is still intended to be initiated by setback acceleration, which is considered to be in the direction of the arrow 330 shown in FIG. 9*d*. In particular, the inertial igniter is similarly intended to be initiated by setback accelerations that are either relatively low level or are relatively short in duration or both relatively low level and relatively short duration. In such applications, the setback acceleration is not long enough in duration to actuate a release mechanism, which is required for safety reasons to prevent accidental initiation, as well as accelerate a striker mass long enough to provide it with enough mechanical energy to achieve ignition of pyrotechnic materials of the inertial igniter upon the previously described pyrotechnic impact (between a two part pyrotechnic components, a pin impacting a one-part pyrotechnic material, a pin impacting a percussion cap, or the like).

The operation of the inertial igniter 300 embodiment with the translating element 320 is as follows. At rest, the tip 308 of the striker link 301 is pressed against the translating element 320 through the ball 310 by the tensile force of the preloaded spring 305 acting on the striker link 301 as can be seen in the schematic of FIG. 9*a*. When the munitions using the inertial igniter is fired, the setback acceleration (in the direction of perpendicular to the plane of the inertial igniter 300, i.e., the plane of FIG. 9*a*) will act on the inertia of the translating element 320 (and the mass 324—if present), causing the translating element 320 to travel down. As the translating element 320 moves down, the surface of the translating element that is in contact with the ball 310 slides pass the ball 310, and when it has moved down enough and passed the ball 310, it is designed to move passed the bottom surface of the striker link 301, thereby clearing the striker link 301 to be released. The latter position of the translating element 320 is shown in dashed line in FIG. 9*d* and with numeral 324. The tensile force of the spring 305 will then accelerate the striker link 301 rotationally in the counterclockwise direction until the pyrotechnic components 313 and 314 impact and cause ignition, FIG. 9*a*. The latter state of the striker link 301 is as shown in FIG. 9*b* for the inertial igniter 300 with the rotating release link 309. The flames and sparks generated by the ignition of the pyrotechnic material 313 and 314 is then routed out from provided ports, usually through a hole such as the hole 318 to below the base to initiate the thermal material pyrotechnics. In some applications, the generated flames and sparks are required to be routed from the side or from the top (opposite to the direction of exit from the hole 318) side of the inertial igniter 300.

It is appreciated by those skilled in the art that the inertial igniter 300 can also operate without the use of the intermediate ball 310 being present between the striker link 301 (preferably near the tip 308) and the translating element 320. However, the inertial igniter 300 is preferably constructed with such an intermediate rolling element to minimize the friction forces between the striker link 310 and the translating element 320. In general, it is desired the said friction forces be as small as possible so that the (downward) force that the setback acceleration needs to generate while acting on the inertia of the translating element 320 to translate the translating element 320 down to release the striker link 301 is minimized. By minimizing the said required downward setback acceleration generated force, the inertia of the translating element 320, i.e., the size of the resulting device is also reduced.

It is appreciated by those skilled in the art that the aforementioned compressive biasing spring 322 is selected such that in the case of accidental drops or other similar accidental (no-fire) events, the translating element 320 is not translated downwards enough to clear the ball 310, i.e., to release the striker link 301.

The inertial igniter 300 can also be readily modified to operate as a so-called electrical G-switch upon activation by the aforementioned all-fire setback acceleration and thereby close (open) a normally open (closed) electrical circuit. The construction and operation of the electrical G-switch is identical to those of the inertial igniter 300 of FIGS. 9*a*-9*d*, except that the pyrotechnic components 313 and 314 of the inertial igniter 300 are replaced by contact and circuit closing (opening) elements described below.

In one embodiment of the resulting electrical G-switch, the pyrotechnic component 314 of the inertial igniter 300 (FIG. 9*a*) is replaced with the contact element 151 (as shown in FIG. 7*a* and the close-up view "A" of FIG. 7*b*1) and its pyrotechnic component (or striker pin) element 313 by the contact bridging element 152 (as shown in FIG. 7*a* and the close-up view "B" of FIG. 7*b*2). All other elements of the resulting G-switch are identical to those of the inertial igniter 300 of FIG. 9*a*.

The contact element 151, replacing the pyrotechnic component 314 of the inertial igniter 300 (FIG. 9*a*) and the close-up view "A" of which is shown in the schematic of FIG. 7*b*1, is similarly fixed to the structure 302 of the resulting electrical G-switch.

The contact element 152, replacing the pyrotechnic component 313 of the inertial igniter 300 (FIG. 9*a*) and the close-up view "B" of which is shown in the schematic of FIG. 7*b*2, is similarly fixed to the striker link 301 of the resulting electrical G-switch.

It is also appreciated by those skilled in the art that all alternative features and methods of construction and operation described for the electrical G-switch 150 of FIG. 7*a* may also be applied to the present electrical G-switch resulting from the inertial igniter 300.

The resulting electrical G-switch operates in a manner similar to the inertial igniter 300 of FIGS. 9*a*-6*b*, i.e., as a result of the all-fire setback acceleration, the tip of link 309 that engages the tip 308 of the link 301 via the intermediate ball 310 is pushed down, thereby releasing the striker link 301 as was previously described for the inertial igniter 300. The tensile force of the spring 305 will then accelerate the striker link in the counterclockwise direction until the contact strip 164 of the contact element 152 (close-up view "B" of FIG. 7*b*2) comes into contact with the contacts 153 and 154 of the contact element 151 (close-up view "B" of FIG. 7*b*2) as shown in the schematic of FIG. 7*d* for the G-switch 150. As a result, the wires 155 and 156 are connected electrically, and the circuit to which they are connected is closed.

It is appreciated by those skilled in the art that similar to the electrical G-switch 150 of FIGS. 7*a*-7*d*, more than two contacts 153 and 154 may be provided on the contact element 151, thereby allowing the electrically conductive strip 164 of the contact element 152 to close more than one electrical circuit (when using pairs of contacts 153 and 154 and electrically isolated electrically conductive strips 164 on the contact elements 151 and 152, respectively) or allowing at least three contacts (similar to contacts 153 and 154) on the contact element 151 to form a junction by an electrically conductive strip 164.

It is appreciated by those skilled in the art that as was described for the electrical G-switch 150 of FIG. 7*a*, the electrical G-switch resulting from the inertial igniter 300 may be designed for opening an already closed electrical circuit by replacing the pair of contact elements 151 and 152 shown in FIGS. 7*b*1 and 7*b*2, for example by the alternative contact elements 171 and 172, respectively, which are shown in the close-up views "C" and "D" in the schematics of FIGS. 8*a* and 8*b*. The G-switch will then operate as was described for the 150 of FIG. 7*a*.

It is also appreciated by those familiar with the art that all alternative designs and variations that were previously described for the G-switch embodiment 150 of FIG. 7*a* may also be applied to the present G-switch embodiment resulting similarly from the inertial igniter 300 of FIG. 9*a* and its disclosed variations.

It is appreciated by those familiar with the art that spinning rounds are fired in rifled barrels so that as the round is accelerated along the length of the barrel to the desired barrel exit velocity, the round is also accelerated rotationally (about its long axis) to the desired barrel exit spin rate. Hereinafter, the rotational acceleration about the long axis of the round (i.e., the spin axis) is referred to as the "spin acceleration", and the spin acceleration corresponding to the all-fire setback acceleration experienced by the round during firing is referred to as the "all-fire spin acceleration".

In another embodiment, a method for constructing inertial igniters that utilizes the aforementioned all-fire spin acceleration to initiate pyrotechnic materials of the igniter is described together with examples of such inertial igniter designs. These all-fire spin acceleration activated inertial igniters are intended to stay inactive, i.e., do not initiate, when subjected to axial acceleration (even the setback acceleration) and rotary accelerations that are not along the long axis of the round.

Such "all-fire spin acceleration" activated inertial igniters have a very important safety advantage over inertial igniters that are activated by setback acceleration. This safety advantage results from the fact that during acceleration drops, even from relatively high heights, e.g., from the aforementioned heights of 40 feet, that could result in accelerations of up to 18,000 Gs with durations of up to 1 msec, can only induce spin acceleration levels that are a very small fraction of the round all-fire spin acceleration levels. As a result, such inertial igniters are particularly suitable from the safety point of view for the so-called spinning rounds, i.e., those rounds that are fired by rifled barrels to achieve (usually high) spin rates, sometimes of the order of magnitude of several hundred spins per second.

Figure 10:
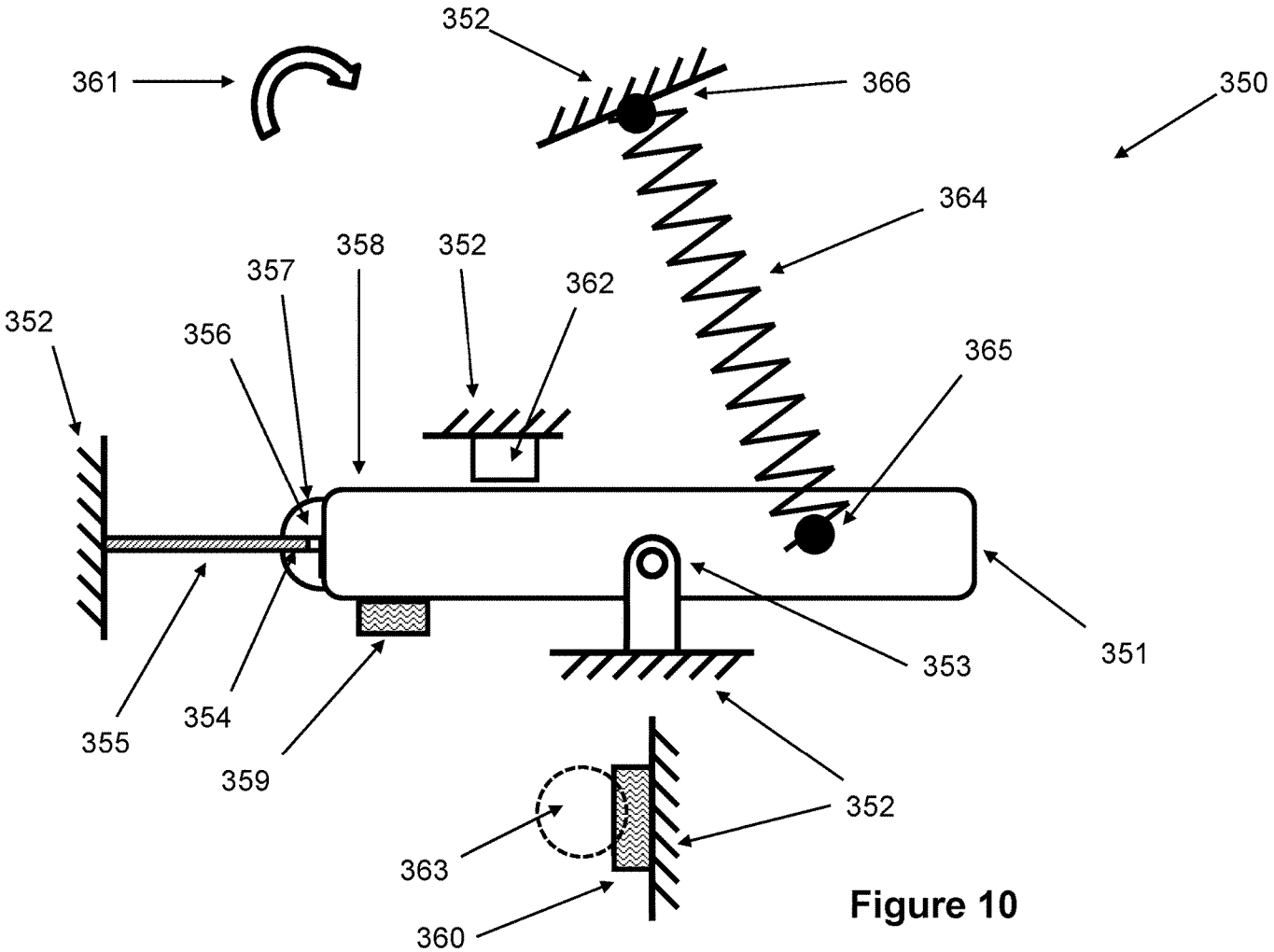
FIG. 10 illustrates a schematic of another embodiment of an inertia igniter configured to initiate pyrotechnic materials when subjected all-fire spin acceleration for use in so-called spinning rounds, i.e., rounds that are fired by rifled gun to gain high spin rate about their long axis for stability upon gun barrel exit.

One representative embodiment 350 of such "all-fire spin acceleration" activated inertial igniter is shown in the schematic of FIG. 10. In this embodiment, the striker component of the inertial igniter 350 is the rotary striker 351, which is attached to the structure of the inertial igniter 352, by a pin joint indicated with numeral 353. The tip 354 of a relatively elastic beam element 355 or the like, which is attached to the structure of the inertial igniter 352, is positioned to engage mating groove 356 of a groove providing portion 357 attached (such as being integral) to the tip 358 of the rotary striker 351. The elements 359 and 360, fixed to the rotary striker 301 and the inertial igniter structure 352, respectively, are the two components of the ignition pyrotechnic. Alternatively, a one piece pyrotechnic element may be used, in which case the element 359 is preferably the ignition impact mass or pin and the element 360 is preferably the one piece impact initiated pyrotechnic element. The inertial igniter 350 is intended to be initiated by the aforementioned firing setback acceleration induced (all-fire) spin acceleration, which is considered to be in the direction by the arrow 361 in FIG. 10.

In general, a stop 362 which is attached to the inertial igniter structure 352 is provided to prevent the clockwise rotation of the rotary striker 351, FIG. 10.

The operation of the embodiment 350 is as follows. At rest, and its pre-activation configuration, the tip 354 of the elastic beam 355 engages the groove 356 of the groove providing portion 357 attached to the tip 358 of the rotary striker 351. As a result, the elastic beam 355 provides resistance to the rotational motion of the rotary striker 351 about the pin joint 353 as shown in the schematic of FIG. 10. When the munitions using the inertial igniter 350 is fired by a gun, the setback acceleration and the barrel rifling forces the round to be also accelerated rotationally about the long axis of the round, i.e., causes the round to be subjected to an all-fire spin acceleration, in the direction of the arrow 361, noting that the direction of the firing acceleration is intended to be perpendicular to the plane of the FIG. 10 and outward from the plane.

When the round is fired, as the setback acceleration and thereby the spin acceleration (in the direction of the arrow 361—i.e., clockwise direction) of the round structure (to which the inertial igniter structure 352 is attached) is increased, the essentially stationary rotary striker 351 begins to be accelerated in the same clockwise direction by the engaging elastic beam 355. The clockwise acceleration of the rotary striker 351 acts on the moment of inertia of the rotary striker 351, generating a resisting (dynamic reaction) torque. The resisting torque in turn needs to be generated by a force applied by the engaging elastic beam 355 to the rotary striker 351 tip 358 at the groove 356. As a result, the elastic beam begins to deflect in bending (downward as seen in the schematic of FIG. 10), until the clockwise acceleration being applied to the rotary striker 351 is large enough to cause enough deflection of the tip 354 of the elastic beam 355 to free the rotary striker 351 from engagement with the elastic beam 355. From this moment of disengagement of the rotary striker 351 from the elastic beam 355, the inertial igniter structure 352 continues to spin accelerate in the clockwise direction (direction of the arrow 361). As a result, pyrotechnic component 360 is accelerated towards the pyrotechnic component 359, until they impact and cause ignition. The flames and sparks generated by the ignition of the pyrotechnic material 359 and 360 are then routed out from provided ports, usually through a hole such as the hole 363 in the inertial igniter structure 352 below its base to initiate the thermal material pyrotechnics. In some applications, the generated flames and sparks are required to be routed from the side or from the top (opposite to the direction of exit from the hole 363) side of the inertial igniter 350.

The length of the engaging tip 354 inside the groove 356 and the stiffness of the elastic beam 355 determine the level of torque that the rotary striker 351 needs to apply to the elastic beam 355 to disengage it from the said elastic beam (following certain amount of—preferably elastic—bending deformation of the elastic beam 355), i.e., the level of spin acceleration at which the rotary striker 351 is released. This level is generally desired to be relatively high for safety reasons, i.e., to prevent inertial igniter activation during accidental drops as previously discussed. The level of spin acceleration at which the rotary striker 351 is released is also desired to be relatively high so that to increase the relative speed of the pyrotechnic components 359 and 360 at the time of their impact to ensure ignition reliability.

Figure 15:
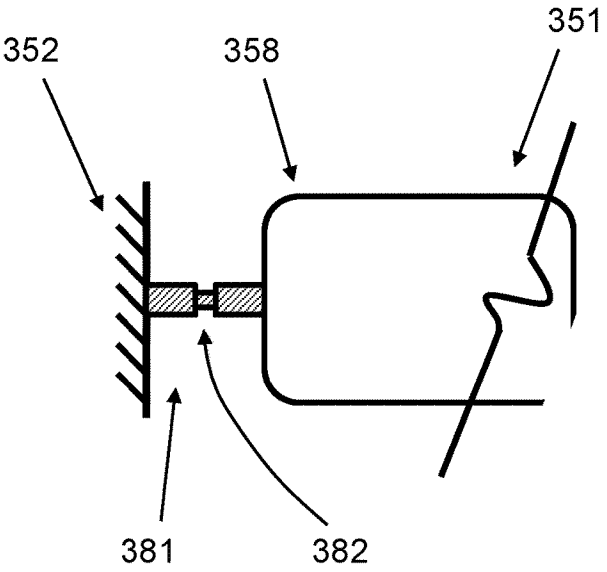
FIG. 15 illustrates an alternative means of releasing the rotary striker of the inertial igniter of the embodiment of FIG. 10 under all-fire spin acceleration via the controlled breakage of a shear pin.

It is appreciated by those familiar with the art that a number of elastic element types known in the art may be used instead of the elastic beam 355 to perform the same function, i.e., accelerate the rotary striker 351 in the clockwise direction to certain desired release acceleration level (generally significantly below the all-fire spin acceleration levels) before releasing the rotary striker 351. Alternative methods of achieving the same goal can also be achieved using a connecting element 381 to connect the tip 358 of the rotary striker 351 to the inertial igniter structure 352 as shown in FIG. 15. The connecting element 381, in this case a shearing pin, is then designed to fail (i.e., break) to shear and release the rotary striker 351 at the desired spin acceleration level. In general, the shear pin 381 can be provided with a notch 382 to concentrate shearing stress in that section of the shear pin 381 to achieve more controlled shearing at the desired spin acceleration level.

Figure 16:
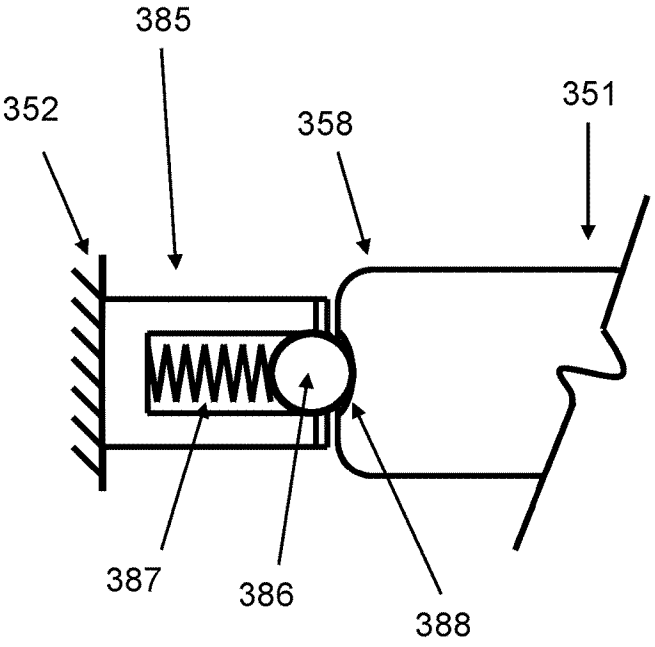
FIG. 16 illustrates another alternative means of releasing the rotary striker of the inertial igniter of the embodiment of FIG. 10 under all-fire spin acceleration via a detent pin.

Another alternative method of achieving rotary striker release at the desired spin acceleration level is the use of a detent pin 385 as shown in the schematic of FIG. 16. The detent pin 385 is attached to the inertial igniter structure 352 and its locking ball 386, which is biased forward by the preloaded compressive spring 387, engages the dimple 388 provided on the tip 358 of the rotary striker 351. The size of the detent ball and the depth of the dimple and its preloading spring would then determine the level of acceleration at which the rotary striker 351 is released during the firing.

In addition, the elements (such as the elastic element 355) providing the aforementioned resisting torque may be positioned at the rotary joint 353, and may be of a torsion spring type.

It is noted that the center of mass of the rotary striker 351, FIG. 10, can be located along the axis of rotation of the rotary joint 353. By such positioning of the center of mass of the rotary striker 351, any accidental acceleration (in the axial or lateral directions or rotational accelerations about axes perpendicular to the spin axis), even very high axial or lateral accelerations caused by drops from aforementioned high heights causing linear accelerations of up to 18,000 Gs with duration of up to 1 msec, would not cause a torque about the spin axis (the axis of the rotary joint 353) of the rotary striker 351, therefore would not cause the inertial igniter 350 to be initiated.

The inertial igniter 350 can also be readily modified to operate as a so-called electrical G-switch upon activation by the aforementioned all-fire (setback acceleration induced) spin acceleration, and thereby close (open) a normally open (closed) electrical circuit. The construction and operation of the electrical G-switch is identical to those of the inertial igniter 350 of FIG. 10, except that the pyrotechnic components 359 and 360 of the inertial igniter 350 are replaced by contact and circuit closing (opening) elements described below.

In one embodiment of the resulting electrical G-switch, the pyrotechnic component 360 of the inertial igniter 350 (FIG. 10) is replaced with the contact element 151 (as shown in FIG. 7*a* and the close-up view "A" of FIG. 7*b*1) and its pyrotechnic component (or striker pin) element 359 by the contact bridging element 152 (as shown in FIG. 7*a* and the close-up view "B" of FIG. 7*b*2). All other elements of the resulting G-switch are identical to those of the inertial igniter 350 of FIG. 10.

The contact element 151, replacing the pyrotechnic component 360 of the inertial igniter 350 (FIG. 10) and the close-up view "A" of which is shown in the schematic of FIG. 7*b*1, is similarly fixed to the structure 352 of the resulting electrical G-switch.

The contact element 152, replacing the pyrotechnic component 359 of the inertial igniter 350 (FIG. 10) and the close-up view "B" of which is shown in the schematic of FIG. 7*b*2, is similarly fixed to the rotary striker 351 of the resulting electrical G-switch.

It is also appreciated by those skilled in the art that all alternative features and methods of construction and operation described for the electrical G-switch 150 of FIG. 7*a* may also be applied to the present electrical G-switch resulting from the inertial igniter 350.

The resulting electrical G-switch operates in a manner similar to the inertial igniter 350 of FIG. 10, i.e., when the round is fired, as the setback acceleration and thereby the spin acceleration in the direction of the arrow 361 (clockwise direction) of the round structure to which the inertial igniter structure 352 is attached is increased, the essentially stationary rotary striker 351 begins to be accelerated in the same clockwise direction by the engaging elastic beam 355. The said clockwise acceleration of the rotary striker 351 acts on the moment of inertia of the rotary striker 351, generating a resisting (dynamic reaction) torque. The said resisting torque in turn needs to be generated by a force applied by the engaging elastic beam 355 to the rotary striker 351 tip 358 at the groove 356. As a result, the elastic beam begins to deflect in bending (downward as seen in the schematic of FIG. 10), until the said clockwise acceleration being applied to the rotary striker 351 is large enough to cause enough deflection of the tip 354 of the elastic beam 355 to free the rotary striker 351 from engagement with the elastic beam 355. The inertial igniter structure 352 will then continues to spin accelerate in the clockwise direction (direction of the arrow 361). As a result, the contact element 151 is accelerated towards the contact element 152, until the contact strip 164 of the contact element 152 (close-up view "B" of FIG. 7*b*2) comes into contact with the contacts 153 and 154 of the contact element 151 (close-up view "B" of FIG. 7*b*2) as shown in the schematic of FIG. 7*d* for the G-switch 150. As a result, the wires 155 and 156 are connected electrically, and the circuit to which they are connected is closed. The resulting electrical G-switch is preferably provided with a biasing tensile spring 364, which is attached to the rotary striker 351 on one end and the inertial igniter structure 352 on the other end, preferably by pin joints 365 and 366, respectively, as shown in the schematic of FIG. 10. The presence of the biasing tensile spring 364 ensures that once the contacts 151 and 152 come into contact as is described above, they will stay in contact.

It is appreciated by those skilled in the art that similar to the electrical G-switch 150 of FIGS. 7*a*-7*d*, more than two contacts 153 and 154 may be provided on the contact element 151, thereby allowing the electrically conductive strip 164 of the contact element 152 to close more than one electrical circuit (when using pairs of contacts 153 and 154 and electrically isolated electrically conductive strips 164 on the contact elements 151 and 152, respectively) or allowing at least three contacts (similar to contacts 153 and 154) on the contact element 151 to form a junction by an electrically conductive strip 164.

It is also appreciated by those skilled in the art that as was described for the electrical G-switch 150 of FIG. 7*a*, the electrical G-switch resulting from the inertial igniter 350 may be designed for opening an already closed electrical circuit by replacing the pair of contact elements 151 and 152 shown in FIGS. 7*b*1 and 7*b*2, for example by the alternative contact elements 171 and 172, respectively, which are shown in the close-up views "C" and "D" in the schematics of FIGS. 8*a* and 8*b*. The G-switch will then operate as was described for the 150 of FIG. 7*a*.

It is also appreciated by those familiar with the art that all alternative designs and variations that were previously described for the G-switch embodiment 150 of FIG. 7*a* may also be applied to the present G-switch embodiment resulting similarly from the inertial igniter 350 of FIG. 10 and its disclosed variations.

Figure 11:
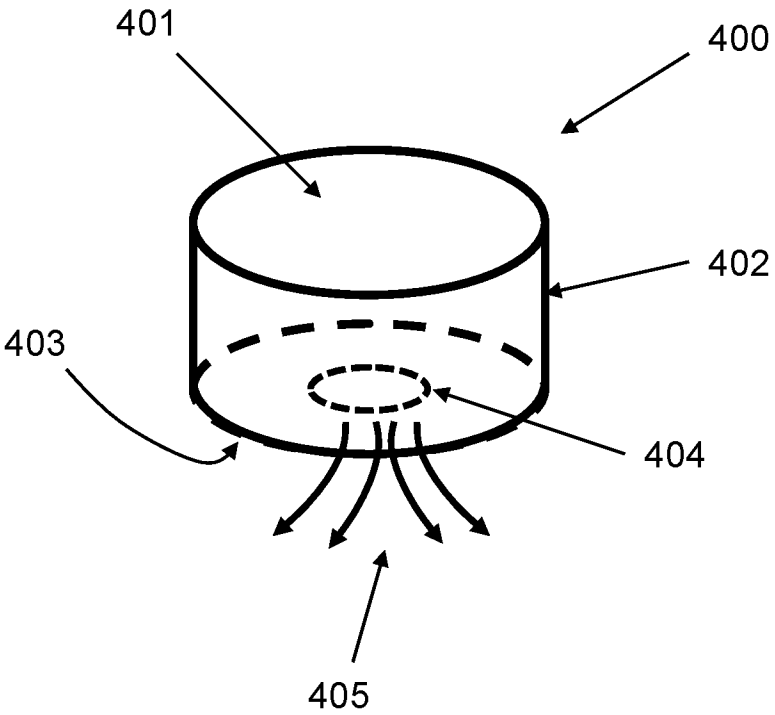
FIG. 11 illustrates an overall isometric view of an inertial igniter of one of the disclosed embodiments packaged in housing with flame exit opening.

The inertial igniter embodiments 100, 300 and 350 shown in the schematics of FIGS. 6, 9 and 10, respectively, and all their indicated variations can be packaged in a relatively rigid housing, such as in the cylindrical package 400 shown in the isometric view of FIG. 11, which can consist of a top cap 401, sidewall 402 and base 403. In general and to make the packaged inertial igniter 400 small, the base 403 (or cap 401) and/or sidewall 402 of the housing can be integral to the structure 102, 302 and 352 of the inertial igniter embodiment 100, 300 and 350 shown in the schematics of FIGS. 6, 9 and 10, respectively. In the isometric view of FIG. 11, the inertial igniter flame exit port 404 is shown to be located on the base 403 of the packaged inertial igniter 400, to allow the flame 405 to exit and initiate the thermal battery in which the packaged inertial igniter is assembled.

The inertial igniter 300 is intended to be initiated by setback accelerations that are either relatively low level or are relatively short in duration or both relatively low level and relatively short duration. In such applications, the setback acceleration is not long enough in duration to actuate a release mechanism, which is required for safety reasons to prevent accidental initiation, as well as accelerate a striker mass long enough to provide it with enough mechanical energy to achieve ignition of pyrotechnic materials of the inertial igniter upon the previously described pyrotechnic impact (between a two part pyrotechnic components, a pin impacting a one-part pyrotechnic material, a pin impacting a percussion cap, or the like).

The inertial igniter 350 is intended to be initiated by setback acceleration induced spin acceleration in spinning rounds (fired by guns with rifled barrels). When center of mass of the rotary striker 351 is located on its axis of rotation (along its rotary joint axis), then no linear (axial or lateral) accelerations or rotational accelerations along axes perpendicular to the spin axis will not initiate the inertial igniter. Therefore the inertial igniter will be safe when dropped from very high heights such as 40 feet that can cause linear accelerations of the order of 18,000 G with up to 1 msec duration.

It is appreciated by those familiar with the art that the inertial igniter housing may be any shape instead of the cylindrical shape as shown in the isometric view of FIG. 11. In addition, the flame exit port may be located almost anywhere on the inertial igniter housing, including the side 402 or the top cap 401, depending on where the igniter pyrotechnic material is located and how it is guided to exit for proper initiation of the thermal battery pyrotechnics.

In certain applications, the thermal battery is required to be initiated under all-fire condition with an extremely high level of reliability, for example, a reliability of even better than 99.999% at 95% confidence level. In such situations, even if an inertial igniter is designed and fabricated for very high initiation reliability under all-fire condition, it might not be capable of satisfying such extremely high reliability level requirements. In addition, even if an inertial igniter is expected to be reliable to such extremely high levels, the process of proving such reliability levels requires extensive and extremely costly testing procedures. For these reasons, it is highly desirable to provide such thermal batteries with at least two, independently activated, inertial igniters to make it possible to achieve such extremely high thermal battery initiation reliability using inertial igniters with significantly lower proven reliability levels that can be achieved at significantly lower costs. The isometric view of FIG. 12 shows such an assembly 420 (indicated by numerals 421) of three packaged inertial igniters 400 over a common base 422.

Figure 13:
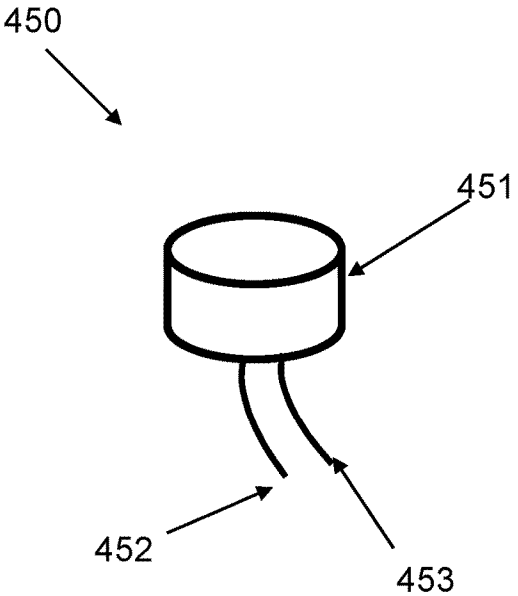
FIG. 13 illustrates an overall isometric view of a G-switch of one of the disclosed embodiments packaged in housing.

It is also appreciated by those familiar with the art that the G-switch embodiment 150, formed from the inertial igniter embodiment 100 of FIG. 6, as well as the G-switches that can be similarly formed as described previously in this disclosure from the inertial igniter embodiments 300 and 350 of FIGS. 9 and 10, respectively, including all their indicated variations, can be packaged in a relatively rigid housing as shown in the isometric view of FIG. 13 and indicated by the numeral 450. Such a housing 451 may, for example, be cylindrical in shape with the G-switch sealed within the housing to protect its elements from environmental effects. The G-switch housing may also be in any shape instead of the cylindrical shape of FIG. 13. The at least two contact wires 452 and 453 may, for example, be brought out from the base of the G-switch packaging 450. Alternatively, the at least two contact tab elements or pins (not shown) commonly used in electronic components may be used for mounting of the G-switch on circuit boards or the like as is common practice in the electronics industry.

In general and to make the packaged G-switch 450 small, the housing can be integral to the structure 102, 302 and 352 of the inertial igniter embodiment 100, 300 and 350 shown in the schematics of FIGS. 6, 9 and 10, respectively, which are used to construct the indicated G-switches.

Figure 12:
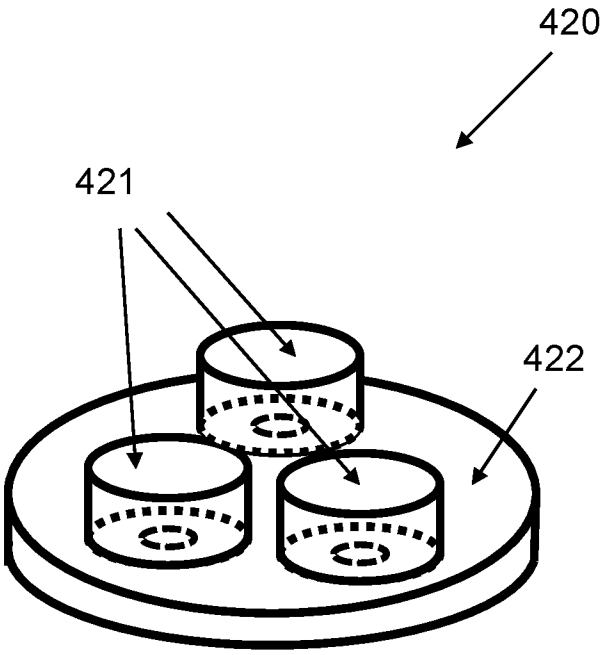
FIG. 12 illustrates the assembly of two or more (in this illustration three) packaged inertial igniters shown in FIG. 11 on a single platform for assembly inside a thermal battery for providing two or more independent means of thermal battery initiation to achieve very high level of thermal battery initiation reliability.
Figure 14:
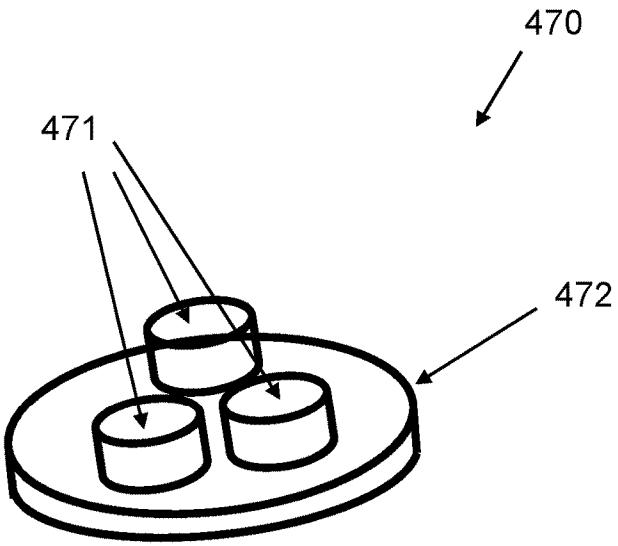
FIG. 14 illustrates the assembly of two or more (in this illustration three) packaged G-switches shown in FIG. 13 on a single platform for providing two or more independent means of detecting all-fire condition to achieve very high level of all-fire condition detection reliability.

It is appreciated by those familiar with the art that similar to the multiple inertial igniter assembly of at least two inertial igniters shown in FIG. 12, two or more G-switches 450 may also be assembled and used to significantly increase the reliability with which the resulting G-switch assembly can detect all-fire condition. An example of an isometric view of such an assembly 470 of three G-switches 471 over a common base 472 is shown in FIG. 14.

In one alternative embodiment of the G-switch assembly 450, at least one of the G-switches of the assembly may be used to detect accidental drops, particularly accidental drops from very high height, such as drops from heights of up to 40 feet that can result in impact shocks of up to 18,000 Gs with up to 1 msec of duration. Similarly, other at least one G-switches may be used to detect shock loadings due other accidental drops or nearby explosions. As a result, the resulting G-switch assembly can be used to differentiate all-fire conditions from almost all no-fire conditions, even drops from very high heights.

While there has been shown and described what is considered to be preferred embodiments of the invention, it will, of course, be understood that various modifications and changes in form or detail could readily be made without departing from the spirit of the invention. It is therefore intended that the invention be not limited to the exact forms described and illustrated, but should be constructed to cover all modifications that may fall within the scope of the appended claims.

What is claimed is:

1. A mechanism comprising:

a toggle link rotatably connected to a base structure about a pivot point;

a first element disposed on a surface of the toggle link at a first position on the toggle link;

a second element disposed on the base structure;

a biasing element having a first end attached to the base structure and a second end attached to the toggle link such that the biasing element biases the first element towards engagement with the second element, the second end of the biasing element being attached to the toggle link at a second position located between the pivot point and the first position; and a blocking element movably disposed between a blocking position blocking movement of the toggle link and an actuated position allowing the first element of the toggle link to move towards the second element when the base structure undergoes an acceleration event greater than a predetermined threshold.

2. The mechanism of claim 1, wherein;

the first element is a first pyrotechnic material; and the second element is a second pyrotechnic material, such that the biasing element acts to bias the first pyrotechnic material towards the second pyrotechnic material when the base structure undergoes an acceleration event greater than the predetermined threshold, and contact between the first and second pyrotechnic materials produces a spark.

3. The mechanism of claim 1, wherein:

the first element is an impact mass; and the second element is an impact initiated pyrotechnic material, such that the biasing element acts to bias the impact mass and the impact initiated pyrotechnic material towards each other when the base structure undergoes an acceleration event greater than the predetermined threshold, and contact between the impact mass and impact initiated pyrotechnic material produces a spark.

4. The mechanism of claim 1, wherein:

the first element is a first contact electrically isolated and disposed on the toggle link; and the second element is at least one pair of second contacts electrically isolated and disposed on the base structure, such that the biasing element acts to bias the first contact towards the at least one pair of second contacts when the base structure undergoes an acceleration event greater than the predetermined threshold, and contact between the first contact and at least one pair of second contacts closes an electrical circuit between the at least one pair of second contacts.

5. The mechanism of claim 1, wherein:

the first element is a nonconductive member; and the second element is at least one pair of second contacts electrically connected to each other, such that the biasing element acts to bias the nonconductive member towards the at least one pair of second contacts when the base structure undergoes an acceleration event greater than the predetermined threshold, and contact between the nonconductive member and at least one pair of second contacts opens an electrical circuit between the at least one pair of second contacts.

6. The mechanism of claim 1, wherein the blocking member comprises a rotary member having at least a portion interfering with the toggle link in the blocking position, the rotary member rotating from the blocking position to the actuated position when the base structure undergoes an acceleration event greater than the predetermined threshold.

7. The mechanism of claim 1, wherein the blocking member comprises a translating member having at least a portion interfering with the toggle link in the blocking position, the translating member rotating from the blocking position to the actuated position when the base structure undergoes an acceleration event greater than the predetermined threshold.

* * * * *